US005230635A

United States Patent [19]

Takenouchi et al.

[11] Patent Number: 5,230,635

[45] Date of Patent: Jul. 27, 1993

[54] CONNECTOR WITH LEVER

[75] Inventors: Kenji Takenouchi; Makoto Yamanashi; Takahiro Sano, all of Shizuoka, Japan

[73] Assignee: Yazaki Corporation, Tokyo, Japan

[21] Appl. No.: 903,577

[22] Filed: Jun. 24, 1992

[30] Foreign Application Priority Data

Jun. 25, 1991 [JP] Japan ..... 3-153073
Jun. 26, 1991 [JP] Japan ..... 3-154624
Jul. 3, 1991 [JP] Japan ..... 3-162804

[51] Int. Cl.[5] ..... H01R 13/62

[52] U.S. Cl. ..... 439/157; 439/153; 439/372

[58] Field of Search ..... 439/152-160, 439/372, 476, 484

[56] References Cited

U.S. PATENT DOCUMENTS 2,987,693 6/1961 Wamsley ..... 439/157

FOREIGN PATENT DOCUMENTS 974126 2/1951 France ..... 439/372
52-133993 12/1987 Japan .
62-178469 12/1987 Japan .
56876 2/1990 Japan ..... 439/372
278674 11/1990 Japan ..... 439/372
453456 6/1988 Switzerland ..... 439/372

*Primary Examiner*—David L. Pirlot
*Attorney, Agent, or Firm*—Armstrong, Westerman, Hattori, McLeland & Naughton

[57] ABSTRACT

A connector with a lever according to the present invention comprises: a male connector having a front face and a rear face, and at least one terminal accommodating cavity extending between the front and rear faces; a female connector having a shape of a rectangular frame; cam pins formed on opposing side walls of first one of the male connector and female connector; pin guide grooves engaged with the cam pins, the pin guide grooves formed on opposing side walls of second one of the male connector and female connector; a lever means comprising a pair of levers, a connecting plate for connecting shoulders of the levers, and cam grooves formed on the levers being engaged with the cam pins; a rotating means for rotating the lever means while the pair of levers of the lever means overlapping the pin grooves; and a locking means for locking the second one to the connecting means of the lever means, wherein open ends of the pin guide grooves of the second one overlap the open ends of the cam grooves of the levers, and the lever means is rotated to connect the male connector with the female connector, and after the connection is completed the locking means locks the lever means to the female connector.

7 Claims, 24 Drawing Sheets

CONNECTOR WITH LEVER

BACKGROUND OF THE INVENTION

1. Field of the Invention

This invention relates to an electrical connector, and more particular to a connector with a lever in which connection and disconnection of the connector can be carried out with a small force by the rotation of the lever.

2. Description of the Prior Art

When the number of terminals which are inserted in a connector is increased, a large force is required to connect or disconnect a pair of connectors due to increased contact resistance or force for engagement or disengagement between those connectors, which makes the engagement work difficult.

FIGS. 28 and 29 show the conventional connector with a lever disclosed, for example, in the Japanese Utility model Unexamined Publication No. Showa 52-133993. In this connector, a male connector 100*a* is provided with levers 100*b* with supporting pins 100*a*2 on both sides 100*a*1 thereof. A female connector 100*c* is provided on both sides thereof with cam pins 100*d* which are engaged with cam grooves on the lever 100*b*. Further, a locking means 100*e* for the lever 100*b* is attached to the male connector 100*a*.

In the first conventional connector described above, at the initial engagement of both connectors 100*c* and 100*b*, the cam grooves 100*b*1 of the levers 100*b* are engaged with the cam pins 100*d* and then the levers 100*b* are rotated in the direction shown by an arrow P of FIG. 28, which permits the male connector 100*a* to advance into the female connector 100*c* with a small force due to so-called action of a lever. Then, the engagement of both connectors are completed at the position where the levers 100*b* are engaged with the locking means 100*e* as described in FIG. 29.

FIG. 30 shows a second example of the conventional connector with a lever, which is disclosed in the Japanese Utility model Unexamined Publication No. Showa 62-178469. In the figure, a female connector a is provided on both sides with bosses a1 which are inserted into holes b1 for a lever b. Further, locking projections a2 for the lever b and projecting walls a4 are attached to the female connector a. On both sides of a male connector c is provided locking projections c1, which work as a locking means for tip portions b2 of the lever b when both male and female connectors are engaged with each other.

The lever b has a pair of arms b3 of which end portions are connected with a connecting portion b4 and other end portions are bent to form the holes b1 and the tip portions b2. In the connector with a lever having the structure described above, the male connector c is inserted into the female connector a as shown in FIG. 31A. Then, the lever b is rotated clockwise, that is, in the direction as indicated by an arrow P, to urge a locking projection c1 of the male connector c in the direction as shown by an arrow d by the tip portion b2 of the lever b as illustrated in FIG. 31B. The lever b is further rotated to insert the male connector c into the female connector, which permits an arm b3 of the lever b to abut and engage projections a2 at the complete engagement state described in FIG. 31D by way of the state shown in FIG. 31C.

On the other hand, when the connectors are disconnected, the male connector c must be pulled out by hand while the lever b being rotated counterclockwise and the arm b3 of the lever b being stretched outwardly because no action point for the lever b is provided on the male connector c. Therefore, in the above conventional connector with a lever, although the male connector c is inserted in the female connector a with a small force using the rotation of the lever b, only the force by hand can be applied to the male connector c at the disconnection of the connectors. In other words, there is a room for further modification.

In addition, when the connector is used for an automobile or the like, the lever b is held over the female connector before engagement. However, in this state, not only the lever b may be entangled with electrical wires but also it must be held upright until the engagement work is completed, which causes the work to be worrisome.

FIG. 32 is an exploded perspective view of another conventional connector with a lever. In the figure, denoted a' is a female connector and b' a lever, c' a male connector. On both sides a1' of the female connector a' is provided a pair of pin guide grooves a2' and pins a3' to form a locking means with pin holes b2' attached on both sides b1' of the lever b'. On the upper wall a4' of the female connector a' is mounted a resilient locking piece a6' which has a locking projection a5' at the tip thereof. The resilient locking piece a6' and an end b4' of a window b5' provided on a wall b3' composes a locking means.

On both sides b' of the lever b1' is provided cam grooves b8'. A spring b6' has a pair of winding portions, which are inserted in a pair of pins a3'. Further, both ends B10' of the spring b6' abut concave portions a7' which are integrally formed with the pins a3'. Bent portions b11' of the spring b6' abut the lower wall b3' of the lever b'. At the initial stage of the connection, the lever b' is urged so as to be disconnected from the female connector a'.

On the center portion of each of the side walls c1' is fixed a cam pin c2' to form a locking means with the pin guide groove a2' of the female connector and the cam groove b8' of the lever b'.

With the structure of the connector described above, an end of the wall b3' of the lever b' is apart from the female connector a' by the spring b6' and open ends of the cam groove b8' and the pin guide grooves a2' of the female connector a' overlap each other to receive the cam pins c2' of the male connector c'.

Under the condition described above, the male connector c' is inserted into the female connector a' and then the end b9' of the wall b3' of the lever b' is depressed so that the periphery of the cam grooves b8' of the lever b' slides on the cam pins c2' of the male connector c', permitting the male connector c' to move in the direction that it engages with the female connector a'. At the position where the end b9' of the wall b3' of the lever b' is fully depressed, the end b4' of the window b5' is engaged with the locking projection a5' of the resilient locking piece a6' of the upper wall a4' of the female connector a' to complete the engagement of the female connector a' and the male connector c'.

In order to disconnect the female connector a' from the male connector c', the resilient locking piece a6' of the upper wall a4' of the female connector a' is pushed forwardly to disengage the locking projection a5' and the end b5' of the window b4' of the lever b' with each other. However, since it is insufficient for urging force of the spring itself to disconnect the female connector a' from the male connector c', the end b9' of the wall b3' of the lever must be lifted by hand to slide the periphery of the cam groove b8' on the cam pins c2' of the male connector c'. When the open ends of the cam groove b8' and the pin guide groove overlap each other, the male connector c' is pulled out of the female connector a' by hand to complete the disconnection between those connectors.

Therefore, with the conventional connector described above, the spring built-in is separately required, which provides further production cost and assembling work. In addition, it is difficult to carry out the assembling work since the lever b' must be moved from worker's side to the upright position.

FIG. 33 shows third conventional connector, which is a connector with grommet used for an automobile to connect wires between main body side and door side thereof.

The connector with grommet comprises a female connector a" with a grommet a2" having a resilient locking piece a1", which is provided on the door side, and a plurality of male connectors b" to be inserted into the female connector a", which are installed on the main body side.

When the connector with grommet is installed in the automobile, the male connectors b" are inserted into the female connector a" at the main body side as illustrated in FIG. 33 and then the mated connectors are inserted into a panel hole c" from the male connector side so that a flange a3" abuts the periphery of the panel hole c" and resilient locking pieces a1" are engaged with the periphery of the panel hole c".

Therefore, as the number of terminals which are inserted in a connector is increased, a large force is required to connect or disconnect a pair of connectors due to increased contact resistance between those connectors. As a result, a male connector on main body side is required to be divided into a plurality of male connectors to reduce the contact resistance of the male connectors each, resulting in inefficient assembly work. In addition, as another problem, it is difficult to discover incompletely connected connectors.

SUMMARY OF THE INVENTION

In the connection work for the connector with lever for the first conventional connector described above, the cam groove **100*b*1 of the lever 100*b* is formed so that the distance between the cam pin 100*d* and a shaft 100*a*2 are gradually close to each other in accordance with the operation angle of the lever 100*b*. Therefore, until the connection of the connectors 100*a* and 100*c* is completed and the lever 100*b* is completely locked, the force for inserting one of a pair of connectors always affects the operation of the lever 100*b* as shown in a two-dot chain line in FIG. 9. As a result, the completion of the connection between the connectors can not be confirmed until the condition that the lever 100*e* is engaged with the locking means 100*b* confirmed by visual observation. Further, the force for inserting terminal is applied to the lever 100*b* until the lever 100*b* is fully locked by the locking means 100*e*** at a final stage of the connecting work, which goes against the reduction in the inserting force.

The present invention has been accomplished to overcome the above drawbacks and the object thereof is to increase the speed of the lever operation and to reduce the load at the connection of the connectors by classifying the areas of the cam grooves, which work as the supporting points for the lever **100*b***, into a connecting area and locking area.

In the first example of the conventional connector with a lever, at the first stage of the connection of the male and female connectors, the lever is maintained at a fixed start point by urging the lever with a spring not shown in the direction opposite the direction indicated by the arrow P to secure the engagement of the cam groove of the lever and the cam pin which opposes to the groove, which increases the load against the lever. Therefore, it is another object of the present invention to provide a connector with a lever in which the lever is maintained at the starting position thereof without a spring which works as resistance against the lever.

In the second conventional connector with a lever, although the male and female connectors can be connected with small force by virtue of the operation of the lever, when disconnecting the connectors, only force by hand can be applied to the lever, resulting in inefficiency in the operation.

Therefore, in consideration of the above drawbacks with the conventional connector, another object of the present invention is to carry out the connecting or disconnecting the connectors with small force and to provide a connector with a lever in which the lever is locked by the cam grooves thereof after completion of the connection of the connectors. Further, in the present invention, there is no fear that the lever may be entangled with electrical wires or is broken. In addition, it is not necessary to release the lock of the lever or to support the lever at connection work, which eliminates worrisome work in connecting the connectors.

A further object of the present invention is to provide a connector with a lever in which the lever is maintained at a preliminary locking state when the connectors are preliminarily connected, and after the connectors are completely connected with each other, the lever is maintained at a final locking state.

Further, in the fourth conventional connector with a lever, a male connector is divided into a plurality of connectors to reduce the force for connection or disconnection, resulting in poor working efficiency. In addition, there is another problem that there is difficulty in discovering the condition that the male and female connectors are incompletely connected.

Therefore, it is a further object of the present invention to provide a connector with a lever in which a multiple connector described above can be connected or disconnected with a small force and incompletely connected connectors are detected easily.

It is therefore an object of the present invention to provide a connector with a lever comprising a male connector having cam pin, a female connector having pins guide grooves in which the cam pins of the male connector proceeds, and a lever means rotatably supported with respect to the connectors, the lever means having cam grooves engaged with the cam pins, wherein after the complete engagement of the connectors by the rotation of the lever means, the lever means is locked, and when the lever means is engaged with a positioning projection of the female connector, open ends of the lever means overlap the pin guide grooves of the female connector, and at the initial stage of the engagement of the connectors, the male connector disengaged the lever means from the positioning projection.

In the connector with a lever according to the present invention, a load for engaging the connectors and a load for locking the connectors are divided in accordance with a narrow operation area of the lever means, which follows a wide operation area thereof. As a result, the load for operating the connector is reduced as a whole. Moreover, since no spring is used for positioning the lever means, the operation of the lever is further reduced.

It is therefore a further object of the present invention to provide a connector with a lever comprising: a male connector having cam pins; a female connector having pins guide grooves in which the cam pin of the male connector proceed; a lever means rotatably supported with respect to the connectors, the lever means having cam grooves engaged with the cam pins; and a resilient locking member, which comprises a linear portion having a spring lock portion at a center portion thereof, lock releasing portions extending outwardly from ends of the linear portion, resilient locking portions extending outwardly from ends of the lock releasing portions and mounting portions for mounting the resilient locking member, and the resilient locking portion is assembled along the lever means and urging in the direction that the lock is released, wherein the cam grooves engage with the cam pins at an initial engagement of the male and female connectors, and at least one pair of terminals built-in the connectors are connected and the spring lock portion engages with a locking portion of the female connector at a final engagement of the connectors, and the resilient portions of the resilient locking piece cross over mountain-shaped portions of the female connector at an intermediate engagement of the connectors.

In the connector with a lever according to the above embodiment of the present invention, the recovering force of the resilient locking portion, which is generated when the resilient locking portion of the resilient locking member crosses over the mountain-shaped spring guide portion, acts to reduce the force for the engagement of the connectors.

Further, in the above embodiment, a state in which a pair of connectors is engaged with each other is maintained at the final engagement and the engagement is released by pushing the lock releasing portions to deform the spring lock portions.

It is therefore a further object of the present invention to provide a connector with a lever comprising: a male connector having cam pins; a female connector having pins guide grooves in which the cam pins of the male connector proceed; a lever means rotatably supported with respect to the connectors, the lever means having cam grooves engaged with the cam pins; and a resilient locking member, wherein linear locking grooves are formed adjacent to the cam grooves of the lever means; the supporting holes of the rotating means includes an insertion hole, a disconnection hole, and a slit formed between the holes; bosses are attached to inner side walls of the levers of the lever means; ribs are provided on the same side walls of the female connector that the pin guide grooves are formed, the ribs compose sliding means with the bosses; a preliminary locking projection is attached to the same wall of the female connector that the locking projection is mounted; the lever means is movable in a range between the locking projection and the preliminary locking projection; and supporting pins on the female connector are formed such that the diameter of end portions thereof is larger than that of center portions thereof, whereby at the insertion of the male connector into the female connector, the bosses slide on inner portions of the ribs to position the supporting pins at the insertion hole, and at the disconnection of the male connector from the female connector the bosses slide on outer portions of the ribs to position the supporting pins at the disconnection hole, and the lever means is rotated such that the cam pins engage with the locking grooves to fully connect the male and female connectors, and the lever means is rotated in the opposite direction as the connection to disconnect the connectors at an initial releasing process, and the lever means is shifted for a preliminary engagement such that the supporting pins move from the disconnection holes to the insertion holes at the completion of the disconnection.

It is therefore a further object of the present invention to provide a connector with a lever comprising: a male connector having a front face and a rear face, and at least one terminal accommodating cavity extending between the front and rear faces; a female connector having a shape of a rectangular frame; cam pins formed on opposing side walls of a first one of the male connector and female connector; pin guide grooves engaged with the cam pins, the pin guide grooves formed on opposing side walls of second one of a the male connector and female connector; a lever means comprising a pair of levers, a connecting plate for connecting shoulders of the levers, and cam grooves formed on the levers being engaged with the cam pins; a rotating means for rotating the lever means while the pair of levers of the lever means overlap the pin grooves; and a locking means for locking the second one of the male connector and female connector to the connecting means of the lever means, wherein open ends of the pin guide grooves of the second one of the male connector and female connector overlap the open ends of the cam grooves of the levers, and the lever means is rotated to connect the male connector with the female connector, and after the connection is completed the locking means locks the lever means to the female connector.

It is a further object of the present invention to provide a connector with a lever in which when male and female connectors are fully locked to each other, a connecting plate of the lever means is positioned on the side of the cam pins of one of the male and female connectors with respect to an extension face of an outer wall of the male connector and female connectors, which opposes the connecting plate, prior to the fully locked position, the connecting plate is positioned on the opposite side to the cam pins of the one of the male and female connectors with respect to the extension face.

When the shape of the cam grooves is formed evenly to provide a self-sustaining function or locking function at the final engagement of the male and female connectors, the cam pins are deadlocked in the cam grooves, preventing the connectors from being disconnected by the operation of the lever. On the other hand, when a biased portion is formed in the shape of the cam grooves for smooth disconnection, the self-sustaining function can not be obtained at the final engagement of the connectors and the connector fully connected once will be loosened.

In the above embodiment of the present invention, supporting holes for the lever are classified into an insertion hole and a disconnection hole and the two holes are in communication with each other to change the position for supporting the lever at the connection or disconnection of the connectors. As a result, the cam pins are positioned at the locking grooves to lock the connectors when the connectors are fully engaged, then, the lever is slid to change the position for supporting the lever to the disconnection hole, which permits the connectors to be disconnected smoothly.

Further, in another connector with a lever according to the present invention, on inserting a female connector to a male connector, the force generated when cam pins slide in the cam grooves of the lever moves a resilient locking piece at the tip of the lever from a preliminary locking position to a position where an operator can easily operate the lever, the rotation of the lever with small force will allow the connectors to be engaged and to lock the resilient locking piece to a main locking projection.

In the connector with a lever according to a further embodiment of the present invention, when male and female connectors are fully locked to each other, a connecting plate of a lever is positioned on the side of cam pins of the male connector with respect to an extension face of an outer wall of the male connector and female connectors, which opposes the connecting plate, prior to the fully locked position, the connecting plate is positioned on the opposite side to the cam pins of the male connector with respect to said extension face. Therefore, the condition in which the connectors are incompletely connected is easily detected.

BRIEF DESCRIPTION OF THE DRAWINGS

The present invention will be more apparent from the ensuring description with reference to the accompanying drawing wherein.

DETAILED DESCRIPTION OF PREFERRED EMBODIMENTS

Figure 1:
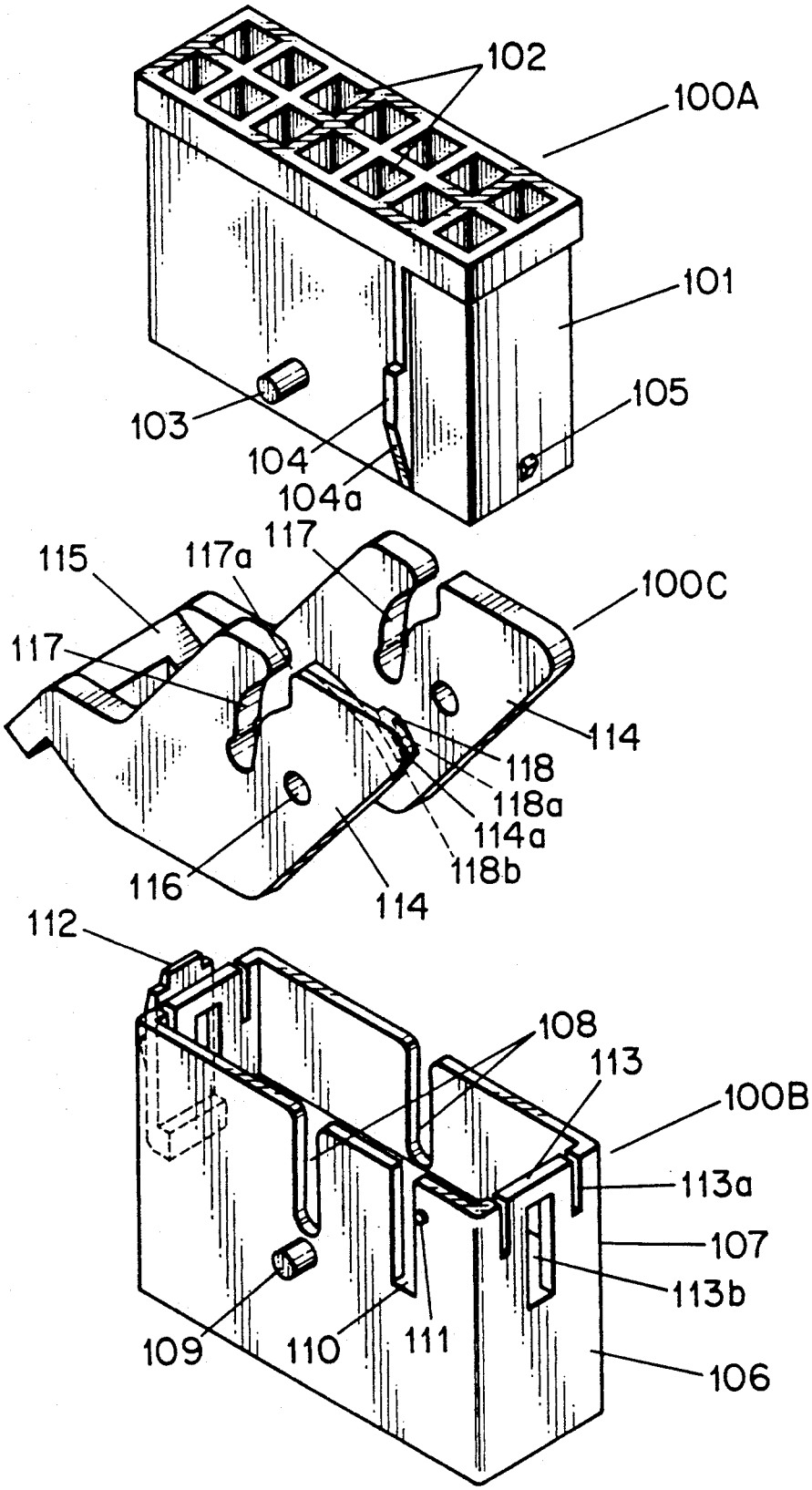
FIG. 1 is an exploded perspective view of a connector with a lever according to a first embodiment of the present invention.
Figure 2:
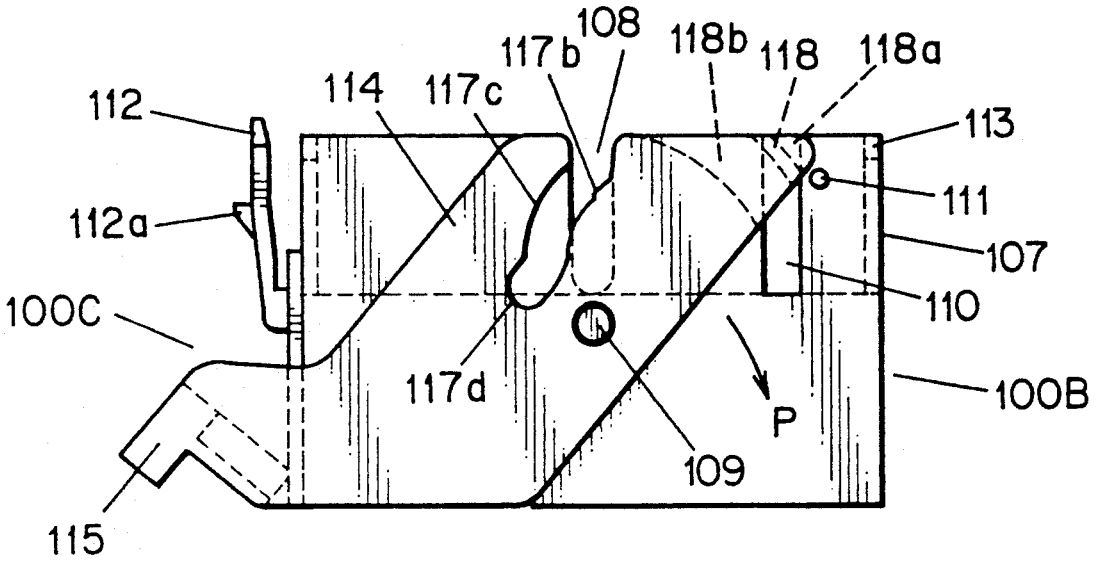
FIG. 2 is a side view of a female connector with a lever.

FIGS. 1 to 7 show a connector with a lever according to a first embodiment of the present invention. In the figures, denoted 100A is a male connector and 100*b* a female connector, 100C a lever. A housing 101 of the male connector 100A, which is made of synthetic resin, has terminal accommodating cavities 102 therein. On both side walls of the male connector are provided cam pins 103 and one of the side walls is provided with a releasing rib 104 extending from a front end to a rear end of the side wall. A preliminary locking piece 105 is attached to a rear wall of the housing and female terminals not shown are accommodated in the terminal accommodating cavities 102. The female connector 100B is provided with a hood 107 for receiving the male connector 100A at a front portion of the housing 106 in which male terminals corresponding to the female terminals are accommodated. The hood 107 is provided with pin guide grooves 108 for cam pins 103 on both sides thereof and pins 109 for supporting the lever 100C.

Further, on one of the side walls is mounted a notch 110 though which the releasing rib 104 proceeds. On the same wall is fixed a positioning projection 111. On a front end of the outer wall opposite to the hood 107 is mounted a resilient locking piece 112 having a locking projection 112*a*. A preliminary locking notch 113*b* is formed at a resilient wall 113 having slits 113*a* on an outer rear wall of the housing 100B.

Figure 8:
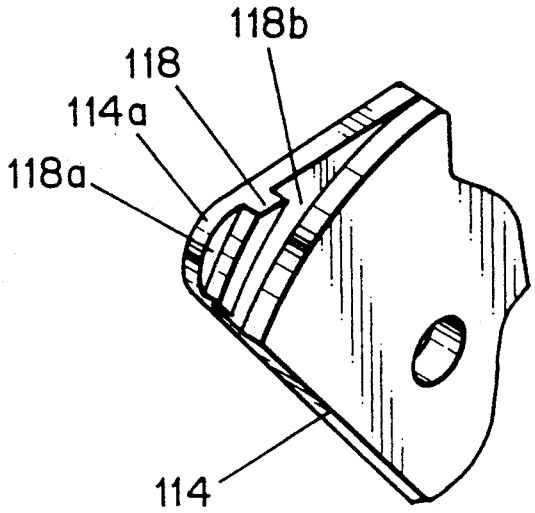
FIG. 8 is a perspective view showing a primary portion of the lever.

The lever 100C has a shape of the letter U in which shoulders of a pair of levers 114 are connected to each other with a connecting plate 115. The levers 114 each has a shaft hole 116 and a cam groove 117 with an open end 117*a*. Further, one of the levers 114 is provided with a projecting portion 118 on a front end of an inner surface thereof as shown in FIG. 8. Inner and outer portions of the projecting portion 118 are formed as large and small notched portions for relief. The cam grooves 117 have a small projections 117*b* adjacent to the open ends 117*a* and on edges of the grooves 117 on the side of the pins 109, and then a first cam groove portion 117*c* for engagement for connectors and a second cam groove portion 117*d* for relieving locking operation follow as shown in FIG. 10.

Now, the assembling work of the connector with a lever will be explained. A pair of levers 114 of the lever 100C are stretched outwardly utilizing its resilience and the pins 109 of the female connector are inserted into the shaft holes 116. At the moment, the connecting plate 115 of the lever 100C is engaged with a rear end of the front surface of the female connector 100B and an end 114*a* of the lever 114 is engaged with the positioning projection 111, which permits the female connector 100B to be maintained at a receiving position of the male connector 100A under the condition that the open ends 117*a* of the lever 100C overlap the pin guide grooves 108 of the female connector 100B.

Figure 3:
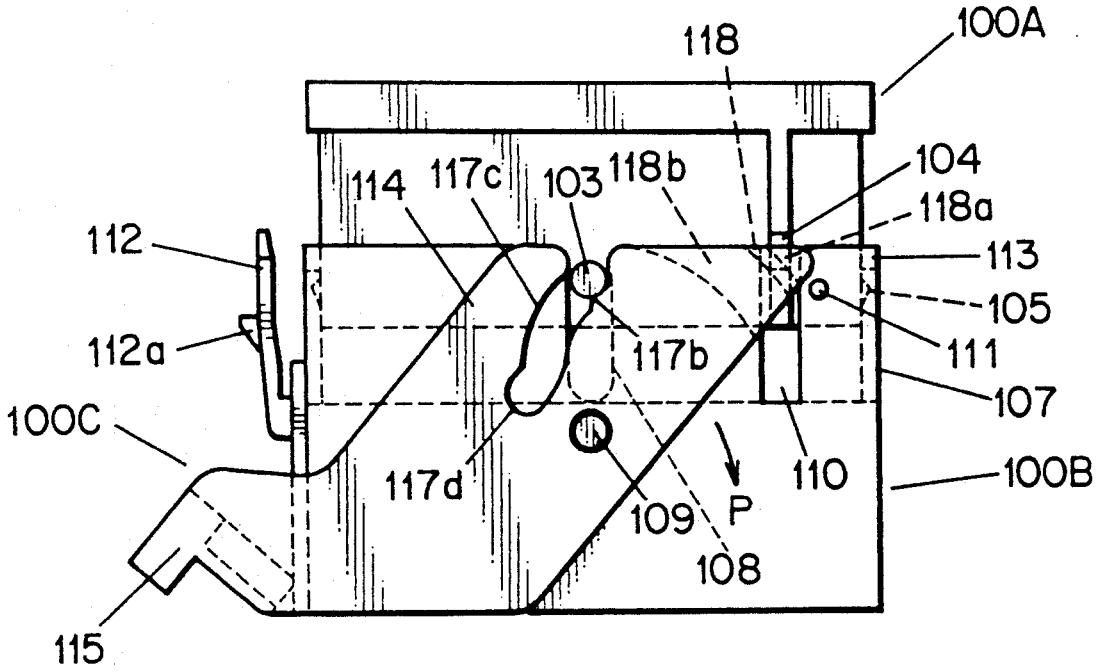
FIG. 3 is a side view of male and female connectors at the start of the connection.
Figure 4:
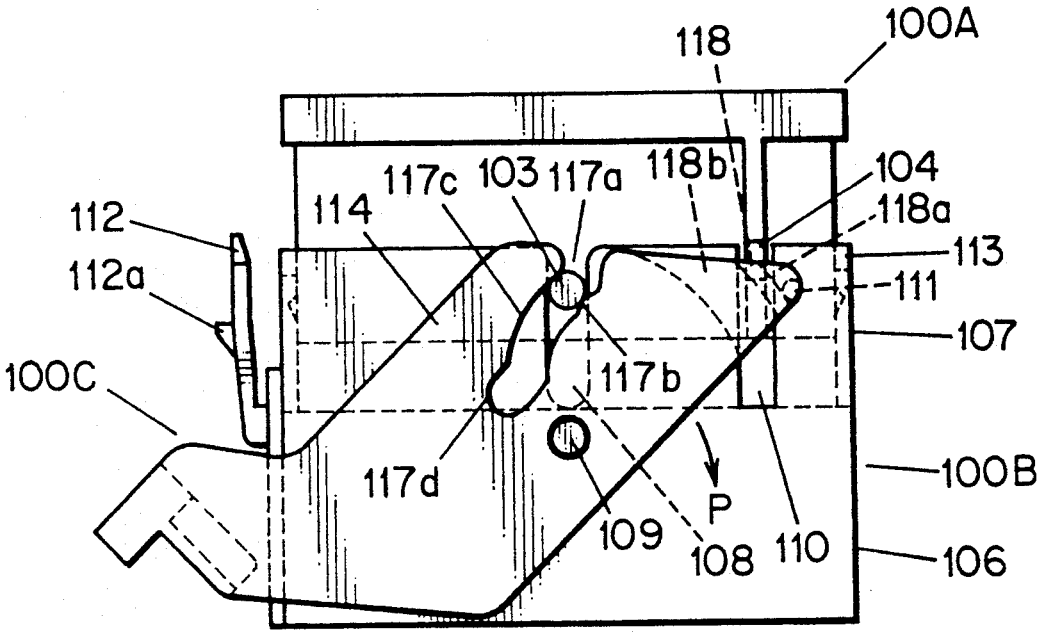
FIG. 4 is a side view of the male and female connectors at initial stage of the connection.
Figure 5:
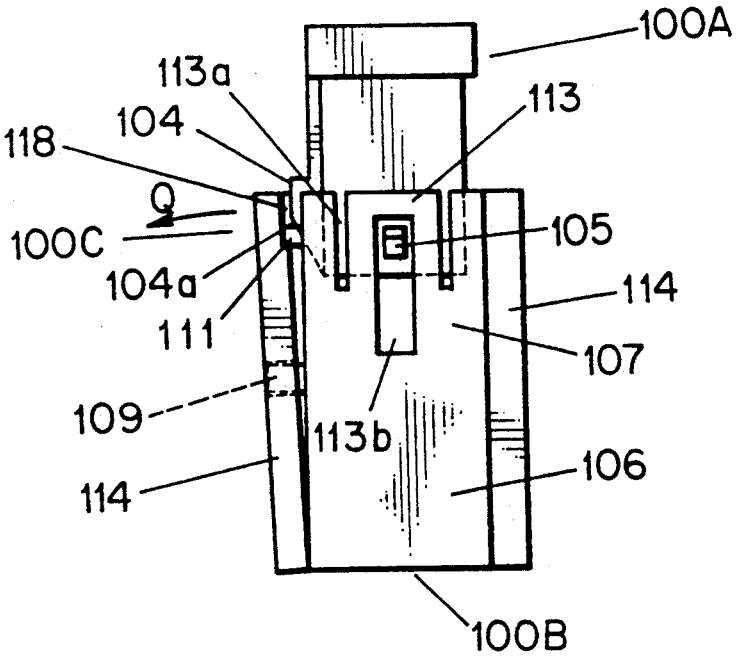
FIG. 5 is a rear view of the male and female connectors at the start of the connection.

Under the condition described above, when the male connector 100A is inserted into the female connector 100B, a preliminary locking projection 105 is engaged with a preliminary locking notched portion 113*b* and the cam pins 103 proceed into the pin guide grooves 108 under this condition to abut the small projection 117*b*. At the same time, a tapered surface of the releasing rib 104*a* abuts the projecting portion 118 as illustrated in FIGS. 3 and 5. Then, on depressing the male connector 100A, the releasing rib 104 urges the end 114*a* of the lever 114 outwardly through the projecting portion 118, the end 114*a* is released from the positioning projection 111 and the cam pins 103 slightly rotate the lever 100C in the direction indicated by the arrow P by way of the small projection 117*b* to hold the positioning projection 111 under the condition that the projection 111 is not in contact with the relieving notched portion 118*a* of the lever 114. As a result, an initial locking state is obtained as shown in FIG. 4.

Figure 6:
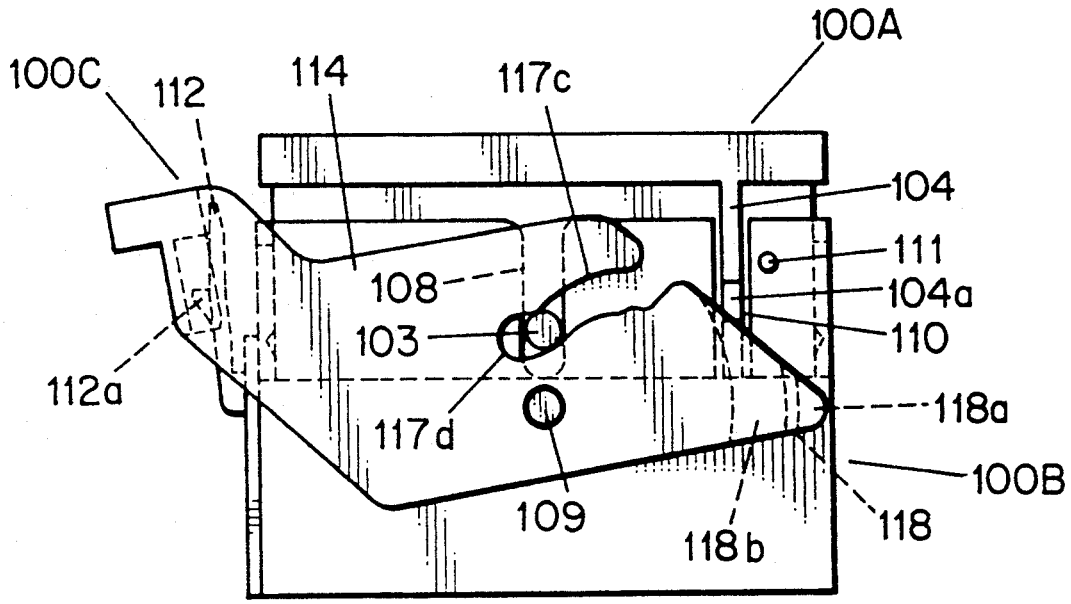
FIG. 6 is a side view of the male and female connectors at the complete connection.
Figure 7:
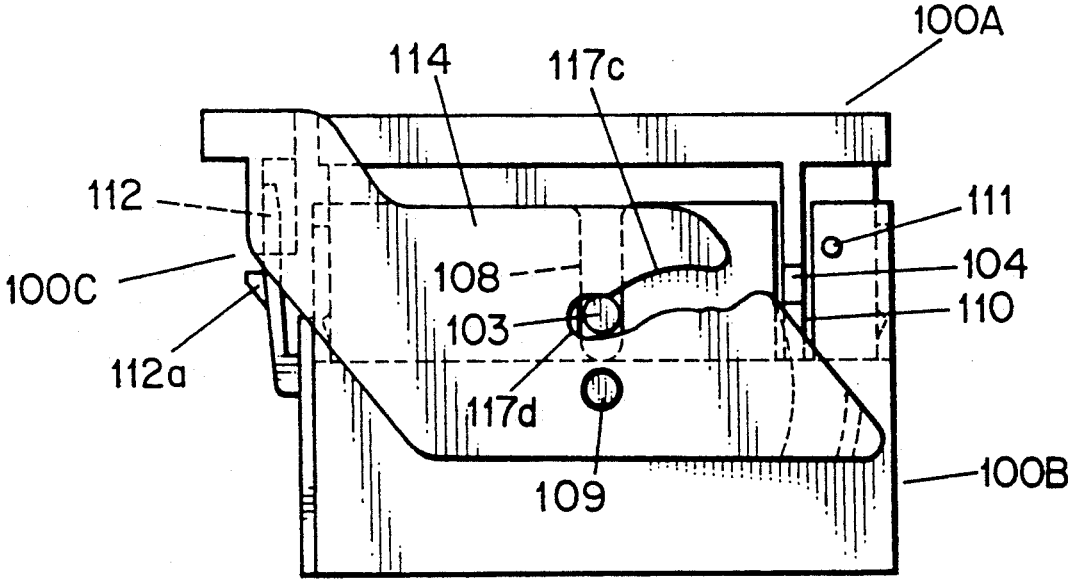
FIG. 7 is a side view of the locked male and female connectors.
Figure 9:
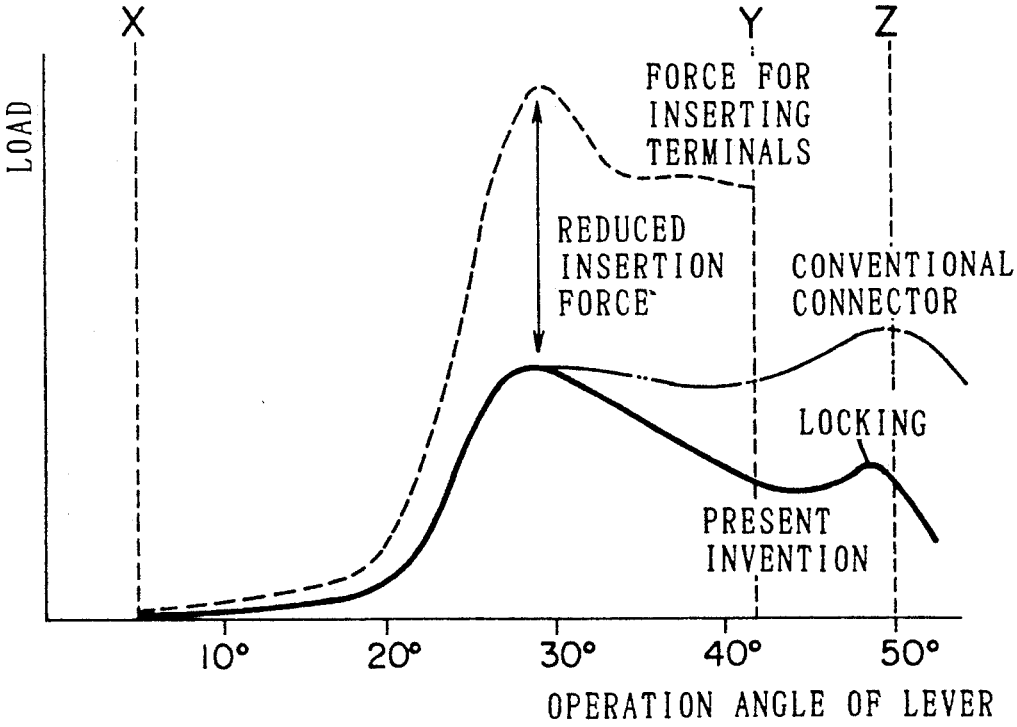
FIG. 9 is a graph showing the relation between lever operating angle and engagement force of the connectors.
Figure 10:
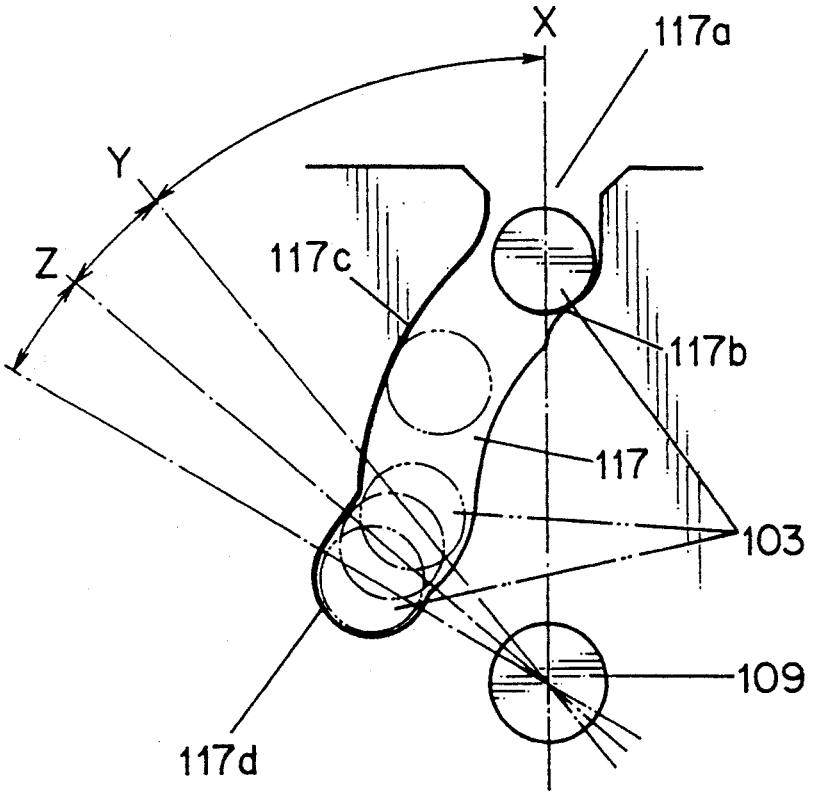
FIG. 10 is a drawing for explaining a process of connecting male and female connectors according to the operation angle of the lever.

Under the condition described above, when the lever 100C is rotated in the direction indicated by the arrow P in the range from the point X to the point Y in FIGS. 9 and 10, the first cam groove portion 117*c* urges the male connector 100A to the female connector 100B through the cam pins 103 to complete the connection of the connectors (corresponding to the point Y in FIG. 9) as shown in the FIG. 6. Then, under the condition that the load for inserting the terminal is eliminated, the lever 100C is rotated by the second groove portion 117*d* so that the rear end of the connecting plate 115 is engaged with the locking projection 112*a* of the resilient locking piece 112 to obtain a locking state (a point Z in FIG. 9) as shown in FIG. 7. The graph in FIG. 9 shows that the load for operating the lever is considerably decreased in the present invention, which is indicated by the solid line, in comparison to that in the conventional connector as described by the two-dot chain line.

As described above, in this embodiment of the present invention, the operation for engaging a pair of connectors with a lever and the operation for locking the pair of connectors with the lever are independently performed. As a result, not only the load for engaging the connectors can be decreased but also the locking operation can be carried out quickly.

Further, in the above embodiment, the lever is to be maintained at a predetermined position for initial engagement without a spring, which also contributes the reduction in the load for engagement.

Figure 11:
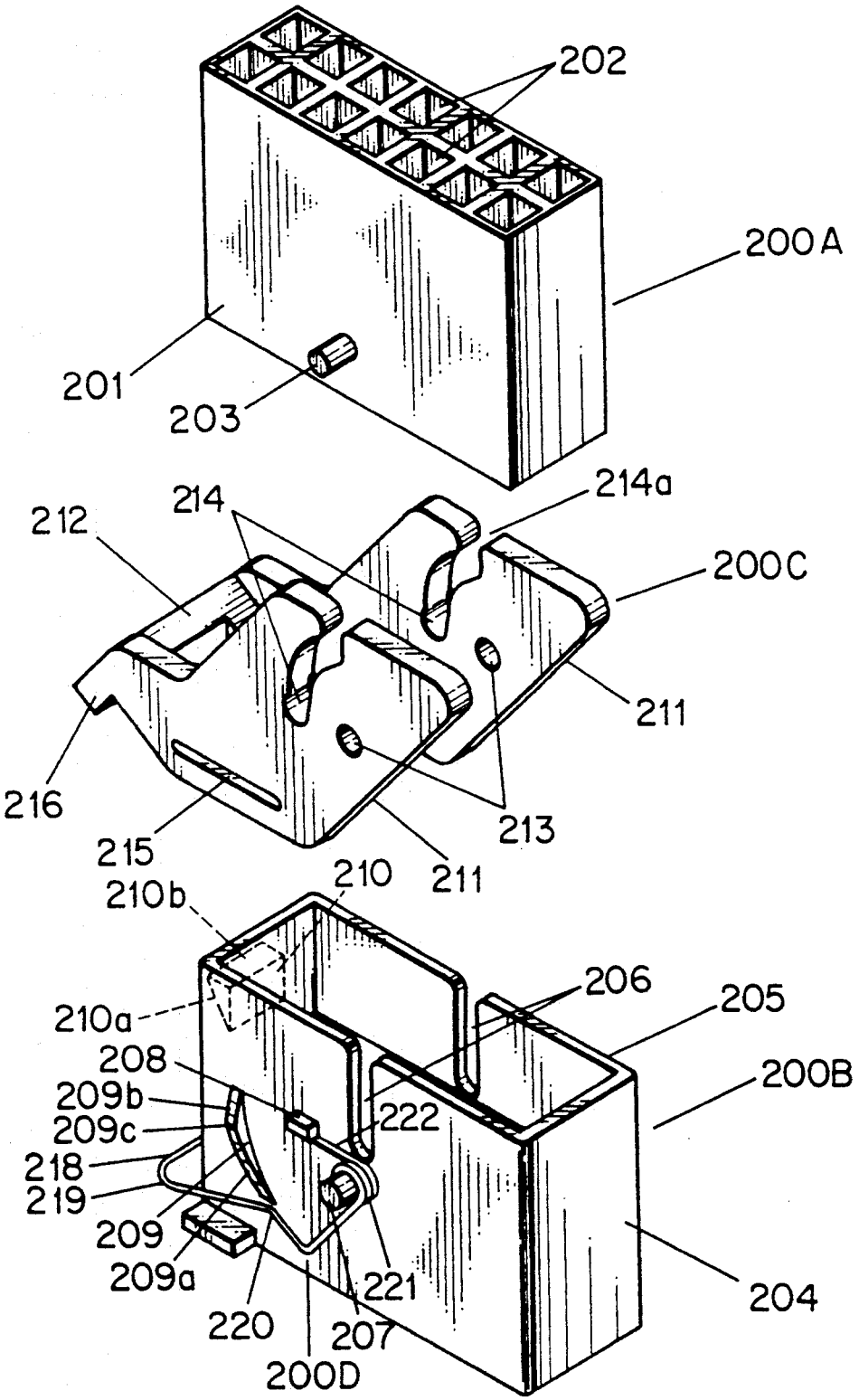
FIG. 11 is an exploded perspective view of a connector with a lever according to a second embodiment of the present invention.
Figure 12:
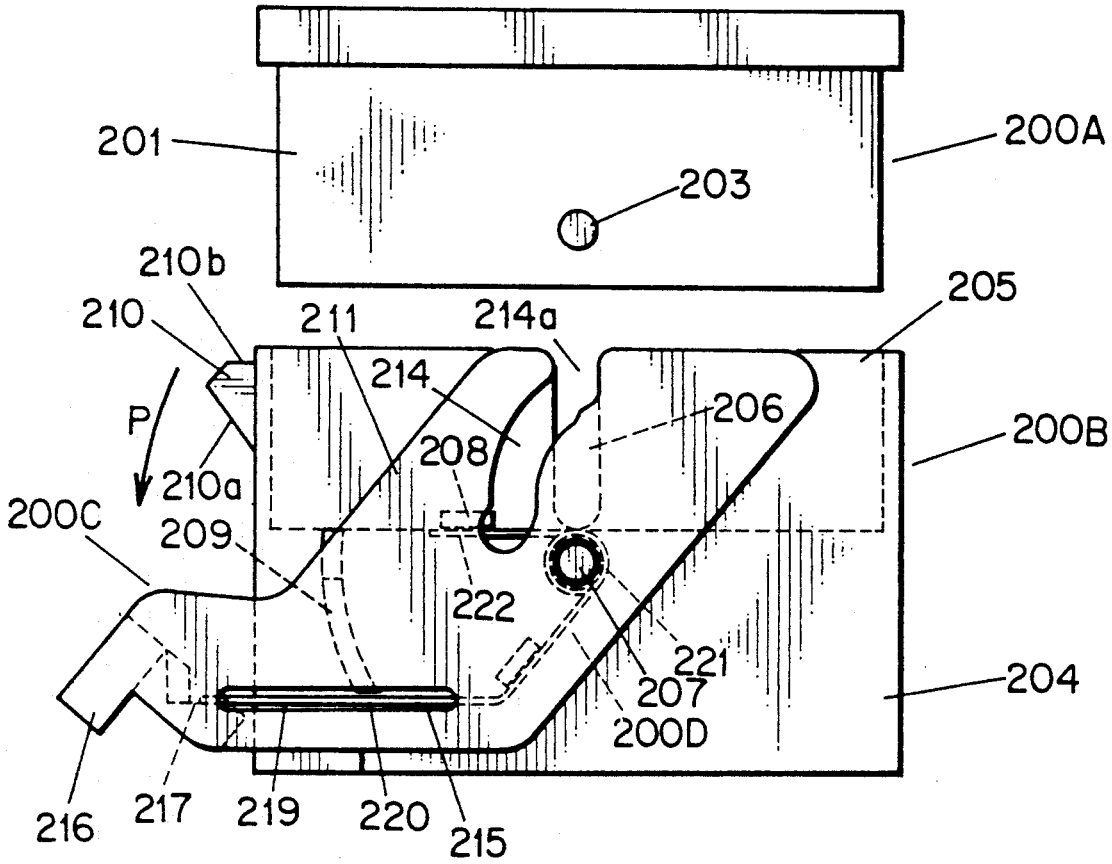
FIG. 12 is a side view of the connector with a lever of FIG. 11 before engagement.
Figure 13:
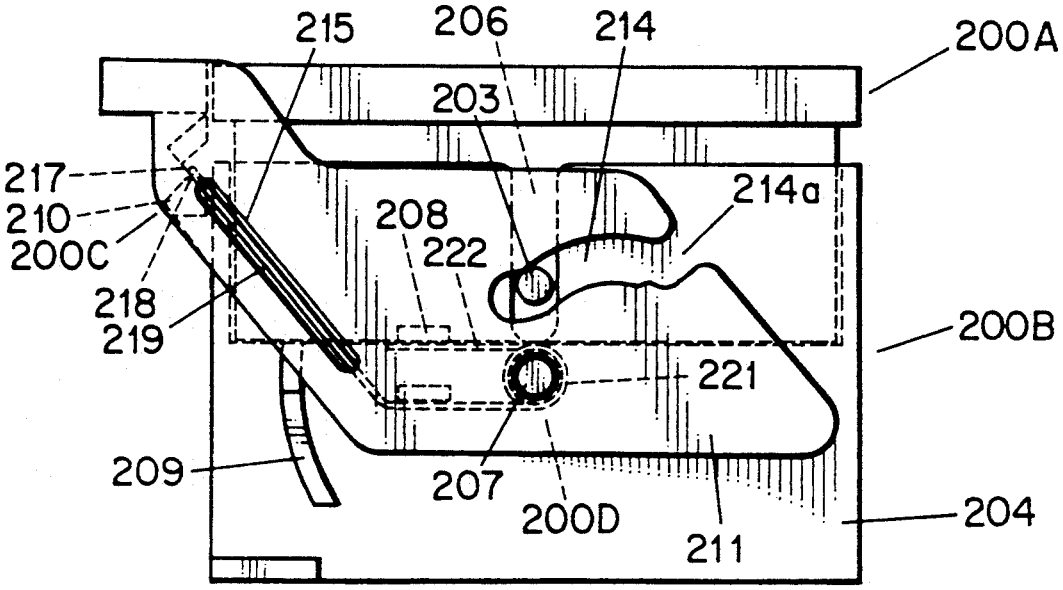
FIG. 13 is a side view of the connector with a lever of FIG. 12 in complete locking state.
Figure 14:
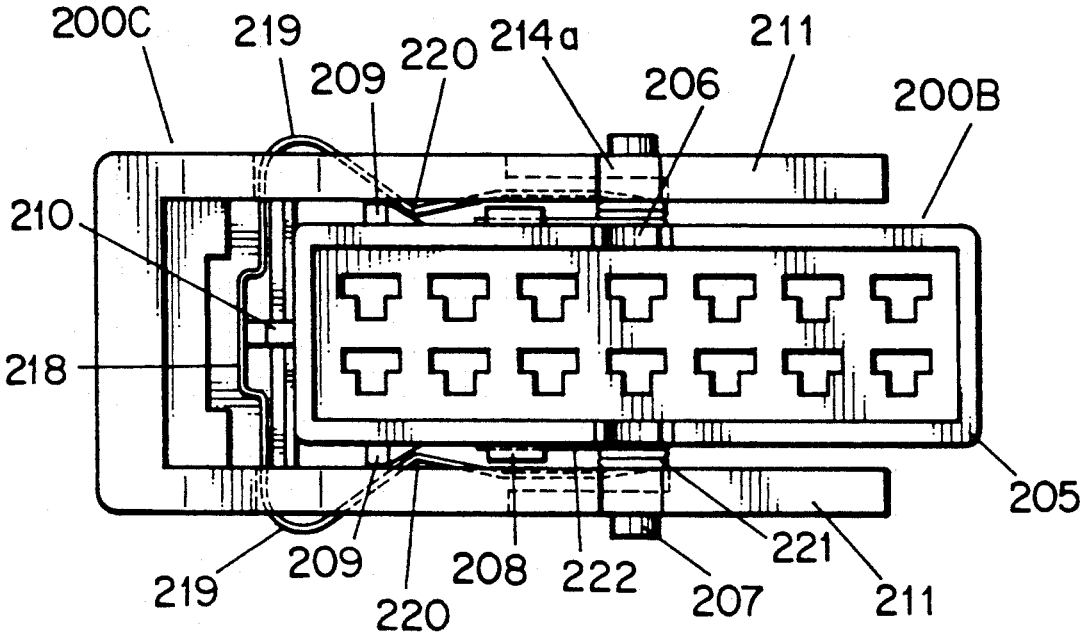
FIG. 14 is a plan view of the female connector described in FIG. 12.

FIGS. 11 to 13 show a connector with a lever according to a second embodiment of the present invention. In the figures, reference 200A is a male connector 200B a female connector, 200C a lever, 200D a resilient locking member. A housing 201 of the male connector A, which is made of synthetic resin, is provided with a plurality of terminal accommodating cavities 202 therein. On front ends of both side walls of the male connector 200A is mounted cam pins 203. In the terminal accommodating cavities are accommodated female terminals not shown. The female connector 200B is provided with a hood 205 at the front portion of a housing 204 for receiving the male connector 200A. On the hood 205 is provided pin guide grooves 206 on both side walls thereof for the cam pins 203 and pins 207 for supporting the lever 200C and the resilient locking member 200D. Further, on the side walls are provided stoppers 208 against the resilient locking member 200D and mountain shaped spring guides 209 having tapered faces 209*a* and 209*b*. On the front end of the upper and outer wall of the hood 205 is mounted a locking projection 210 for the resilient locking member 200D.

The lever 200C has a shape of the letter U in which shoulders of a pair of levers 211 are connected to each other with a connecting plate 212. The levers 211 each has a shaft hole 213 and a cam groove 214 with an open end. Further, the levers 211 are each provided with a spring relieving slit 215 for accommodating a part of the resilient locking member 200D. An operating portion 216 and a spring engaging portion 217 are formed on the connecting plate 212 as shown in FIG. 12.

A resilient wire is bisymetrically bent to form the resilient locking member 200D. The resilient locking member 200D comprises the spring locking portion 218, which works as a connecting portion also, outwardly bending lock releasing portion 219, a resilient locking portion 220, a winding portion 221, and a spring portion 222.

Next, the assembling procedure of the connector will be explained. Under the condition that the spring locking portion 218 of the resilient locking member 200D is positioned on the outer front wall, the winding portions 221 are engaged with the pins 207 on the hood 205 of the female connector 200B to engage the spring portion 220 with the stopper 208 and to position the resilient locking portion 222 behind the spring guide 209.

Then, the pair of levers 211 of the lever 200C are stretched outwardly utilizing its resilience to insert the pins 207 into the shaft holes 213. At this moment, the lock releasing portion 219 of the resilient locking member 200D projects out of the spring releasing slit 215 and the spring locking portion 218 abuts the spring locking portion 217 to accommodate the resilient locking member 200D in the lever 200C.

Next, the connection and disconnection of the connectors will be explained. Under the condition illustrated in FIG. 12, the lever 200C is urged by the resilient locking member 200D in the direction indicated by the arrow P, that is, toward the releasing position side. At this moment, the resilient locking portion 220 of the resilient locking member 200D is located behind a rear tapered face 209*a* of the mountain shaped spring guide 209. The position is defined as a releasing position where the lever 200C is stably maintained. At this position, the open ends 214*a* of the cam grooves 214 overlap the guide grooves 206 of the hood 205.

Figure 15:
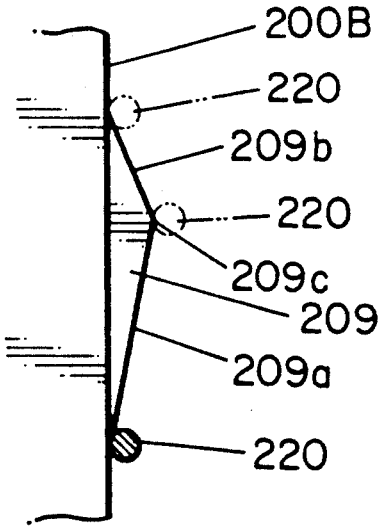
FIG. 15 is a drawing for explaining the relation between a spring guide and a resilient locking member.
Figure 16:
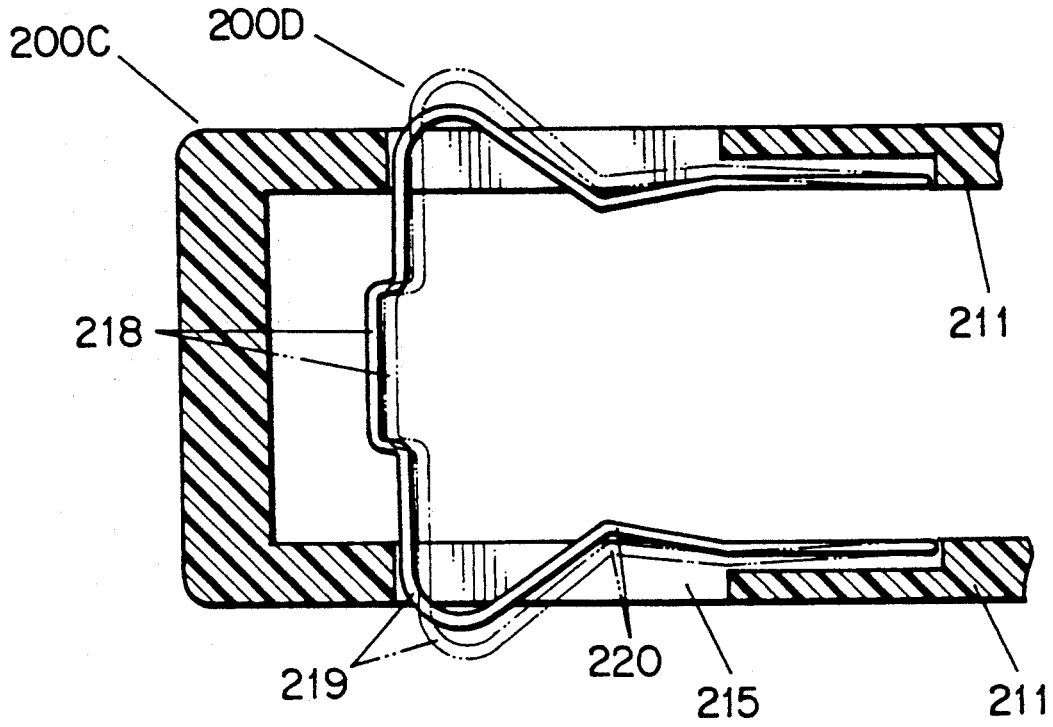
FIG. 16 is a drawing showing the movement of the resilient locking member when it crosses over the spring guide.
Figure 18:
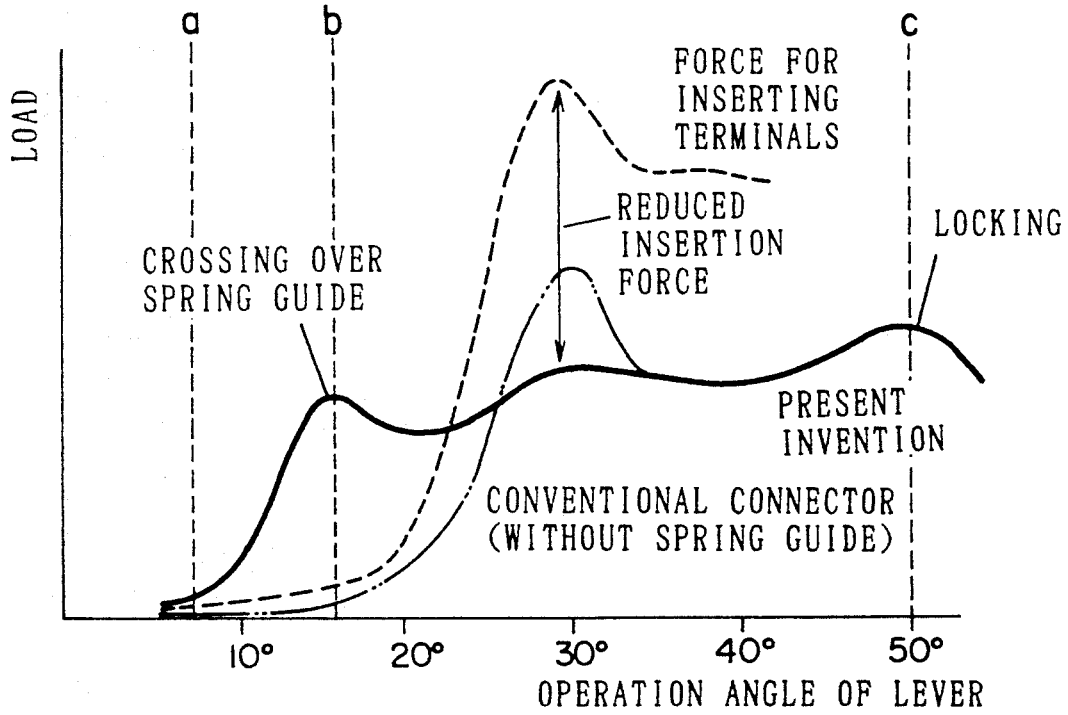
FIG. 18 is a graph showing the relation between the force for engagement and the lever operating angle.

On inserting the male connector 200A into the hood 205 of the female connector 200B under the condition as shown in FIG. 12, the cam pins 203 proceed into the cam grooves 214 of the levers 211 through the pin guide grooves 206 for engagement. In this state, the terminals in the male and female connectors have not yet been in contact with each other, but, only the male connector 200A is softly engaged with the female connector 200B as an initial engagement. Then, when the lever 200C is rotated in the opposite direction to the arrow P by way of the operating portion 216 (corresponding to the point a in FIG. 18), the male connector 200*a* is drawn toward the female connector by the cam grooves 214 which engage with the cam pins 203 so that the resilient locking portion 220 of the resilient locking member 200D is stretched outwardly while retaining contact with the rear tapered face 209*a* of the spring guide 209 to cross over a top portion 209*c* (corresponding to the point b of FIG. 18) as shown in FIGS. 15 and 16. The resilient locking portion 220 urges the engagement of the connectors by recovering its shape on the front tapered face 209*b* as an intermediate engagement. After the resilient locking portion 220 crosses over the spring guide 209, the engagement of the male and female terminals is initiated. FIG. 18 shows that the load for operating the lever is considerably decreased in the present invention, which is indicated by the solid line, in comparison to that in the conventional connector as described by a dotted line. Moreover, the graph describes that the load in the present invention is smaller than the load in a conventional connector without a spring guide, which is indicated by a two-dot chain line. The engagement work for the connectors is carried out with a small force by the lever 200C due to so-called an action of a lever. When the connecting plate 212 approaches the hood 205 by the rotation of the lever 200C, the spring lock portion 218 of the resilient locking member 200D comes in contact with a tapered surface 210*a* of a projecting locking portion 210 and crosses over the surface 210*a* while being stretched outwardly. Then, the spring lock portion 218 engages with an engaging shoulder 210*b* to obtain a final engagement (corresponding to the point c in FIG. 18) as shown in FIG. 3.

Figure 17:
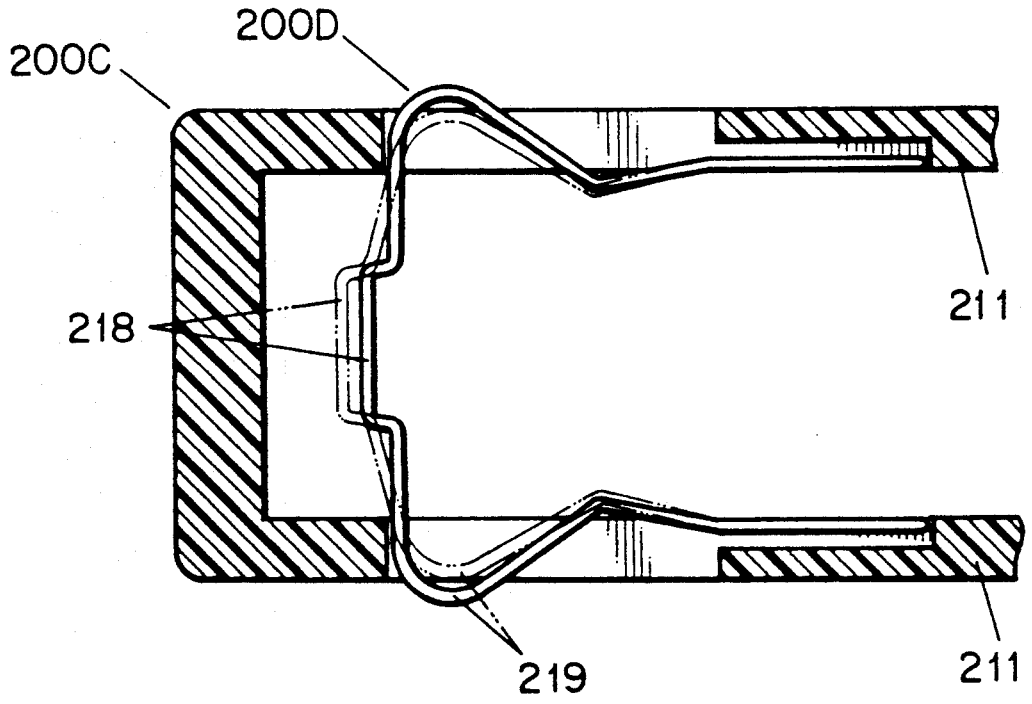
FIG. 17 is a drawing showing the movement of the resilient locking member when unlocked.

In order to disconnect the male connector 200A from the female connector 200B, the pair of lock releasing portions 219 are pressed to stretch the spring locking portion 218 outwardly as illustrated in FIG. 17, permitting the spring locking portion 218 to release the locking projection 210. As a result, the lever 200C rotates in the direction as indicated by an arrow P so that the resilient locking member 200D urges the movement of the lever 200C to the releasing position.

As described above, in the connector with a lever according to the second embodiment of the present invention, the lever is stably maintained at the lock releasing position by the resilient locking member and is prevented from moving to the locking position by the mountain-shaped spring guide, and the resilient locking member is assembled along the lever. As a result, the size of the connector is totally reduced and the lever prevents the resilient locking member from being deformed.

Further, the resilient locking member has already crossed over the mountain shaped spring guide of the female connector prior to the initial stage of the final engagement of the connectors where the pair of terminals accommodated initiates the engagement. Therefore, the recovering force of the resilient locking member can be utilized for the engagement work to reduce the load at the engagement.

Figure 19:
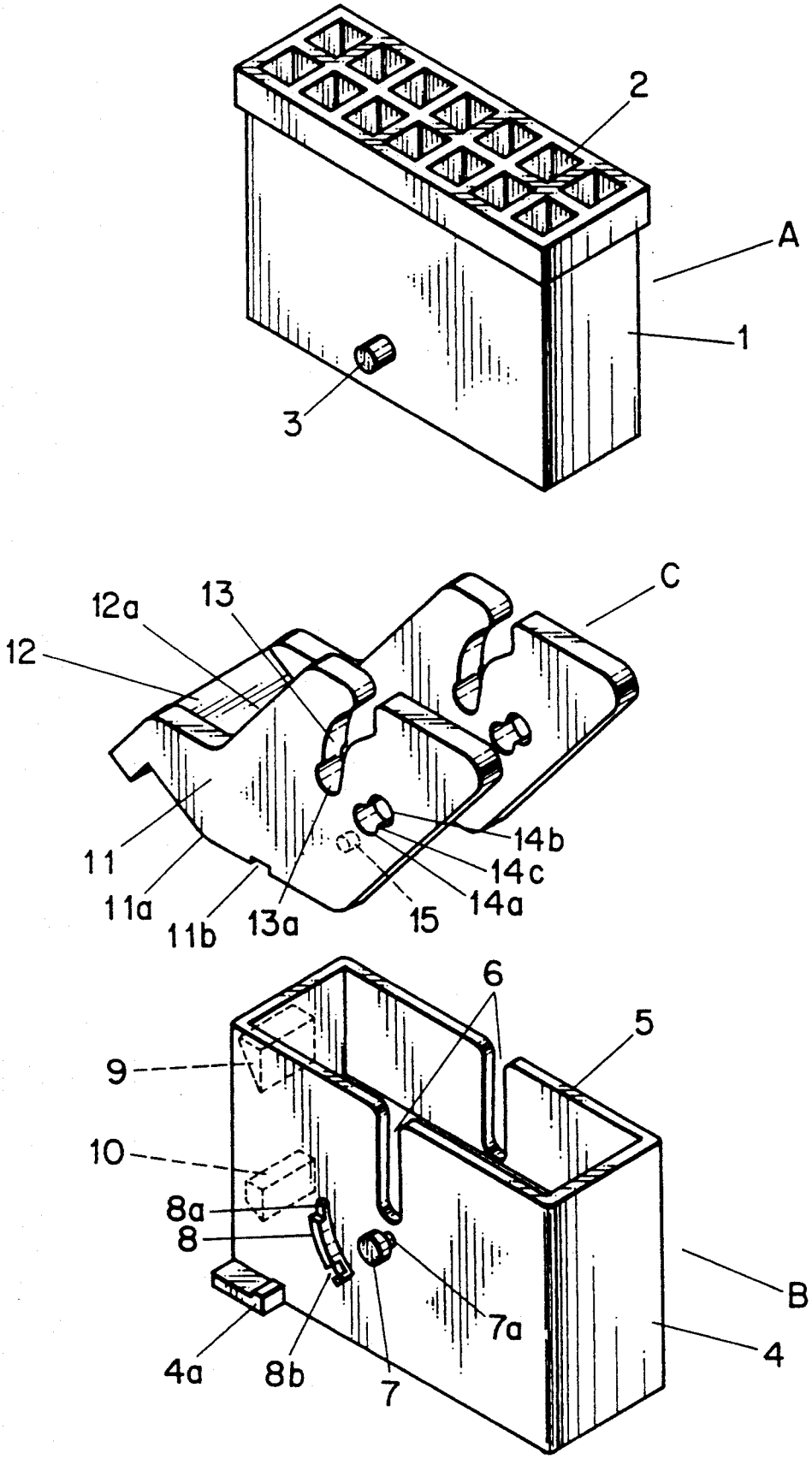
FIG. 19 is an exploded perspective view of a connector with a lever according to a third embodiment of the present invention.
Figure 20:
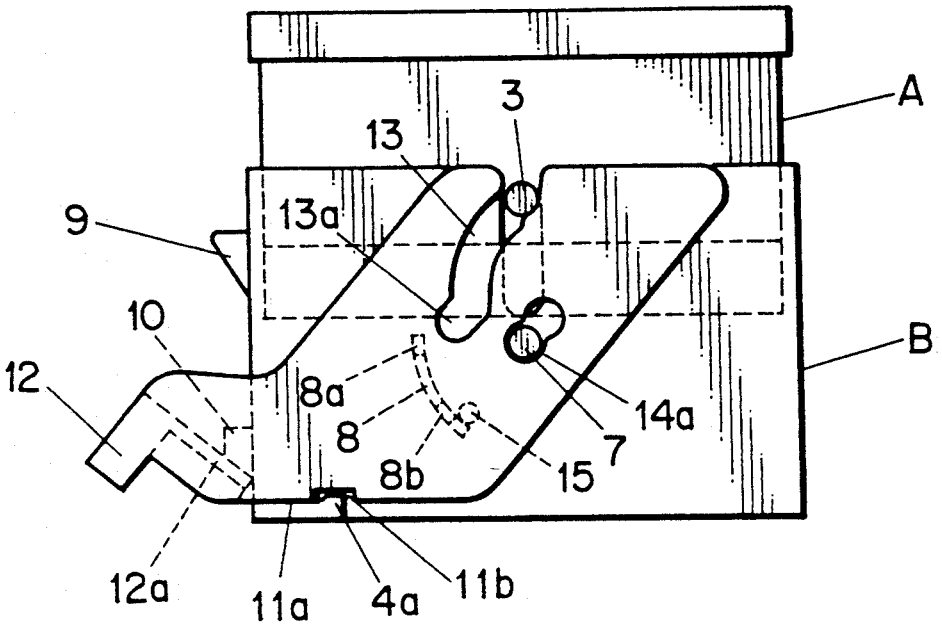
FIG. 20 is a side view of the male and female connector connectors immediately after inserting the male connector into the female connector.
Figure 21:
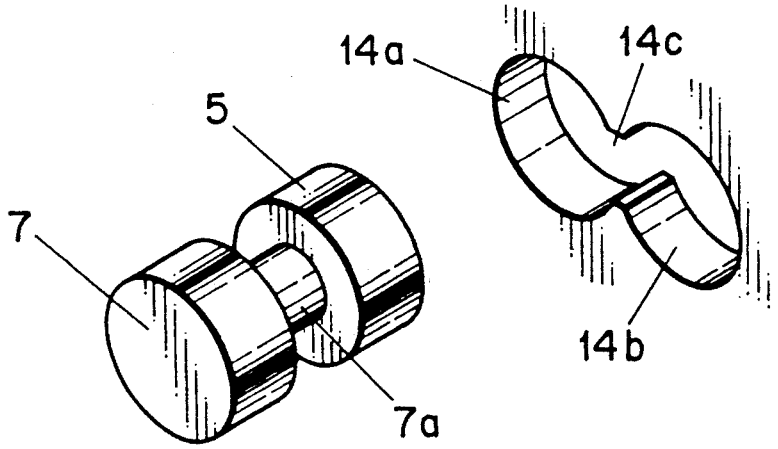
FIG. 21 is a perspective view showing the relation of a supporting pin, a insertion hole, and a disconnection hole.

FIGS. 19 and 20 show a connector with a lever according to a third embodiment of the present invention. In the figures, denoted A is a male connector, B a female connector, and C a lever.

A housing of the male connector which is made of synthetic resin is provided with a plurality of terminal accommodating cavities 2 therein and cam pins 3 on both side walls thereof. In the terminal accommodating cavities are accommodated female terminals not shown.

The male connector B is provided with a hood 5 for receiving the male connector A at a front portion of the housing 4 in which male terminals corresponding to the female terminals are accommodated. The hood 5 is provided with pin guide grooves 6 for cam pins 3 on both sides thereof. Further, pins 7 with narrowed portions 7*a*, which have the shape of spools, are attached to the hood as shown in FIG. 3. On the same side walls of the hood 5 as the pins 7 are mounted, ribs 8 for changing the supporting point of the lever are fixed. The ribs 8 each have a shape of arc and is provided with a shoulder 8*a* at an end and shoulders 8*b* at an intermediate portion thereof. On the other side wall is fixed a final locking projection 9. Further, a preliminary locking projection 10 is attached to a lower end of the side wall of the housing 4, which opposes the position of the final locking projection 9.

The lever C comprises a pair of side plates 11 and a connecting bar 12 for connecting the side plates 11. The connecting bar 12 works as operating portion also. A resilient locking piece 12*a* extends from the connecting bar 12. On the side plates 11 are formed cam grooves 13 having a shape of an arc and linear locking grooves 13*a* adjacent to the cam grooves 13. Further, a supporting hole for insertion 14*a* and a supporting hole for disconnection 14*b* are provided at substantially center portions of the side plates 11 each and a slit 14*c* is formed between the holes 14*a* and 14*b* so that the narrowed portion 7*a* of the pin 7 passes therethrough as shown in FIG. 23. Both holes 14*a* and 14*b* work as supporting means for the pin 7. On the inner wall of the side plates 11 each is provided a boss 15, which composes a sliding means with the rib 8 on the hood 5. On a side wall 11*a* of the pair of side plates 11 each of the levers C is formed with a concave portion 11*b*, which abuts a projection 4*a* on the housing 4 to prevent the lever C from moving downward. Further, the resilient locking piece 12*a* of the connecting bar 12 of the lever C and the preliminary locking projection 10 formed on the housing 4 functions as a locking means for preventing the lever C from moving upward in the preliminary locking state.

The connector with a lever according to the third embodiment of the present invention has a structure as described above. Therefore, in practical use, the pin 7 is supported in the supporting hole 14*a* and the boss 15 is positioned on inner lower portion of the rib 8. The connecting bar 12 is located at a lower position and the resilient locking piece 12*a* is engaged with the preliminary locking projection 10 of the female connector B. The above condition prevents the lever C from moving downward since the concave portion 11*b* of the side end 11*a* of the side plate 11 engages with the projection 4*a* formed on the housing 4.

Figure 22A:
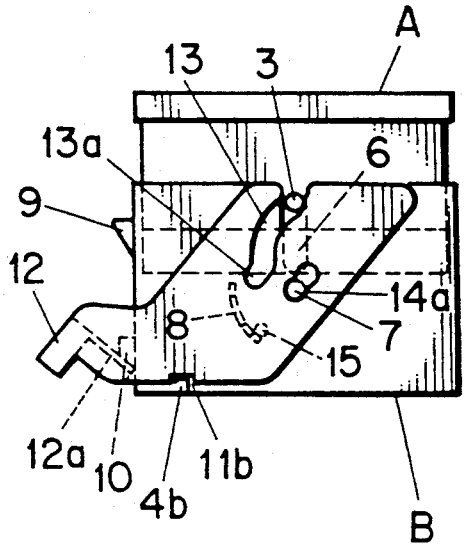
FIGS. 22A to 22D are side views showing process of inserting the male connector into female connector.
Figure 22B:
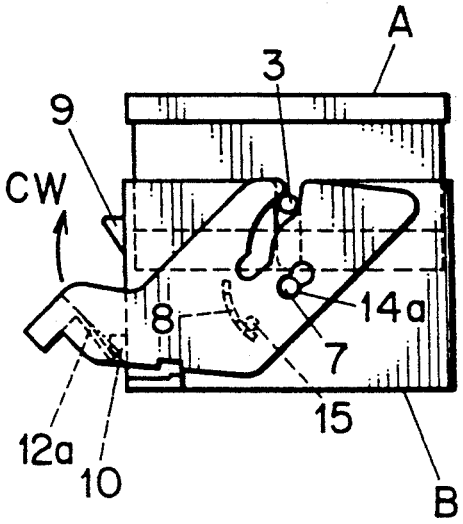
Figure 22C:
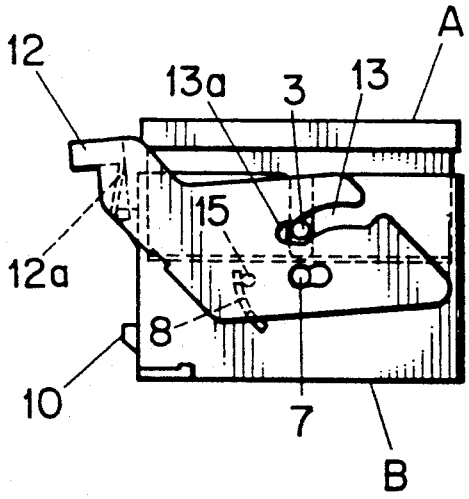
Figure 22D:
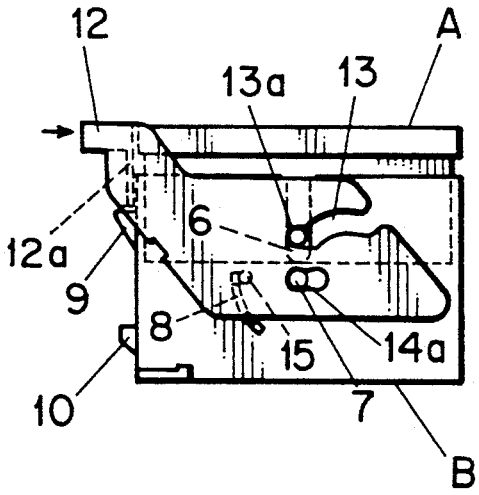

Then, the male connector A is inserted into the female connector B as illustrated in FIG. 22A. At this time, the cam pins 3 of the male connector A are positioned at the pin guide grooves 6 of the hood 5 and the open ends of the cam grooves 13. Next, in the condition as shown in FIG. 22A, when the connecting bar 12 of the lever C is rotated clockwise, the resilient locking piece 12*a* of the lever C is released from the preliminary locking projection 10 and the cam grooves 13 of the lever C slide on the cam pins 3 to apply a force in the direction that the male connector A is inserted. Further, the bosses 15 slide on the inner portions of the ribs 8 so that the pins 7 are maintained in the supporting holes 14*a*. Then, the lever C is rotated up to the position shown in FIG. 22C while the bosses 15 slide on the inner portions of the ribs 8, which permits the male connector A and female connector B to be connected to each other strongly in accordance with the rotation angle of the lever C. At this position, the tip of the resilient locking piece 12*a* of the lever C bends and crosses over the main locking projection 9. At the same time, the cam pins 3 are positioned at the ends of the cam grooves 13 and reach the inlet portions of the locking grooves 13*a*. Then, as shown in FIG. 22D, on pushing the lever C in the direction toward the center of the female connector B, the resilient locking piece 12*a* is fully locked by the main locking projection 9; the cam pins 3 are positioned at the ends of the locking grooves 13*a* of the lever C; and the boss 15 is positioned on the inner portion of the shoulder 8*a* of the rib 8 to complete the engagement of the connectors. At this moment, the cam pins 3 of the male connector A are located at the linear locking grooves so as to be deadlocked and further the resilient locking piece 12*a* of the lever C is engaged with the main locking projection 9, that is, the connectors are doubly locked, preventing the connector from being loosened.

Figure 23A:
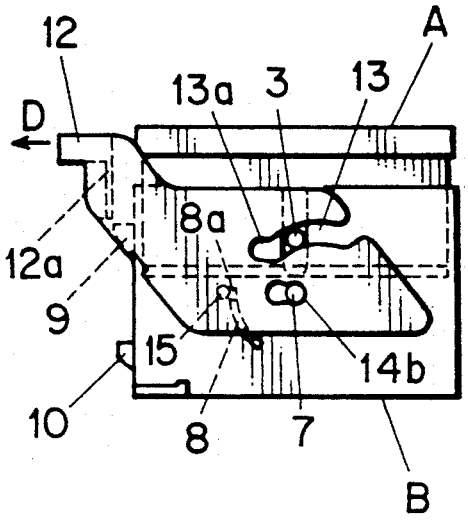
FIGS. 23A to 23D are side views showing a disconnecting process of the male and female connectors.
Figure 23B:
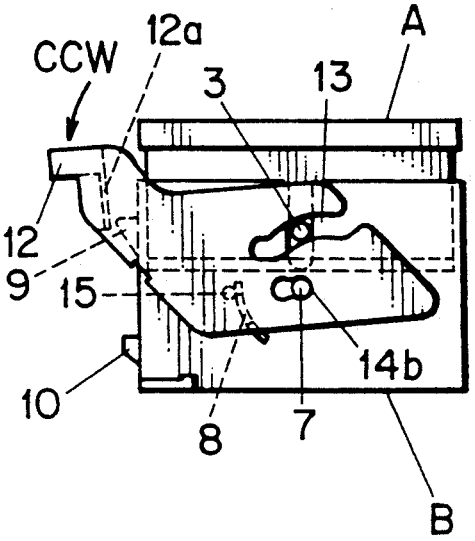
Figure 23C:
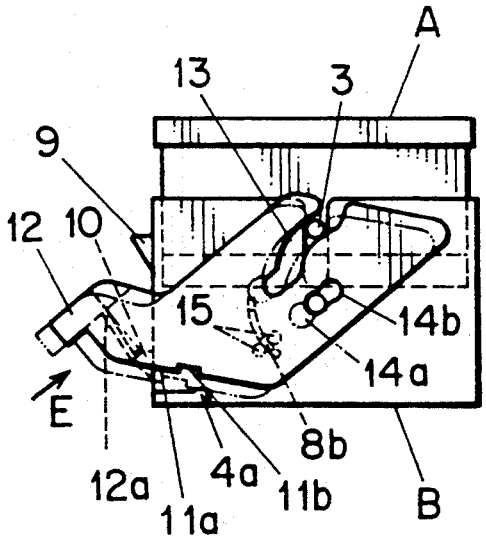
Figure 23D:
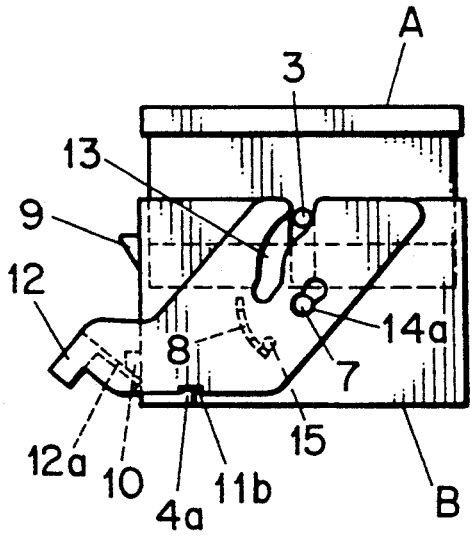

In order to disconnect the male connector A from the female connector B, the lever C is pulled back in the direction indicated by an arrow D as illustrated in FIG. 23A. Then, the resilient locking piece 12*a* is released from the main locking projection 9 and the cam grooves 13 function as slide cams so that the male connector A slightly rises with respect to the female connector B to perform initial disconnection. Then, the cam pins 3 move from the locking grooves 13*a* to the cam grooves 13 and the bosses 15 pass over the shoulders 8*a* of the ribs 8 to be positioned on the outer portions of the ribs 8. Further, the slits 14*c* of the lever C pass through the narrowed portions 7*a* of the pins 7 and the supporting holes 14*b* support the pins 7. Since the resilient locking piece 12*a* has already been released from the main locking projection 9, when the lever is rotated counterclockwise, the bosses 15 change position to the supporting holes 14*b* while sliding on the outer portions of the ribs as shown in FIG. 23B and the cam pins 3 slide in the cam grooves 13 to apply the force for releasing the male connector A from the female connector As illustrated in FIG. 23C, the lever C stops when the ends 11*a* of the side plates 11 of the lever C abut the projection 4*a* of the housing 4 as indicated by the two-dot line in the figure. Then, on pushing the lever C in the direction as indicated by an arrow E, the bosses 15 pass over the shoulders 8*b* of the ribs 8 to be positioned on the inner portions of the ribs 8, and the narrowed portions 7*a* of the pins 7 pass through the slits 14*c* so that the supporting holes 14*a* support the pins 7. Then, when the lever C is further rotated counterclockwise, the concave portions 11*b* of the side plates 11 of the lever C engage with the projections 4*a* of the housing 4 of the female connector B and the resilient locking piece 12*a* crosses over the preliminary locking projection 10 by depressing the piece 12*a*. Then, the resilient locking piece 12*a* engages with the preliminary locking projection 10 to complete the disconnection, permitting the male connector to be pulled out.

As described above, in the connector with a lever according to the third embodiment, the grooves for cam pins for generating the force for connecting or disconnecting the connectors are divided into cam grooves for insertion or releasing and locking grooves for locking. Further, to improve the function of the grooves, the different position is selected for the supporting hole as well as the bosses at connection or disconnection, which allows small force for connecting or disconnecting the connectors and secure double locking after engagement.

Figure 24:
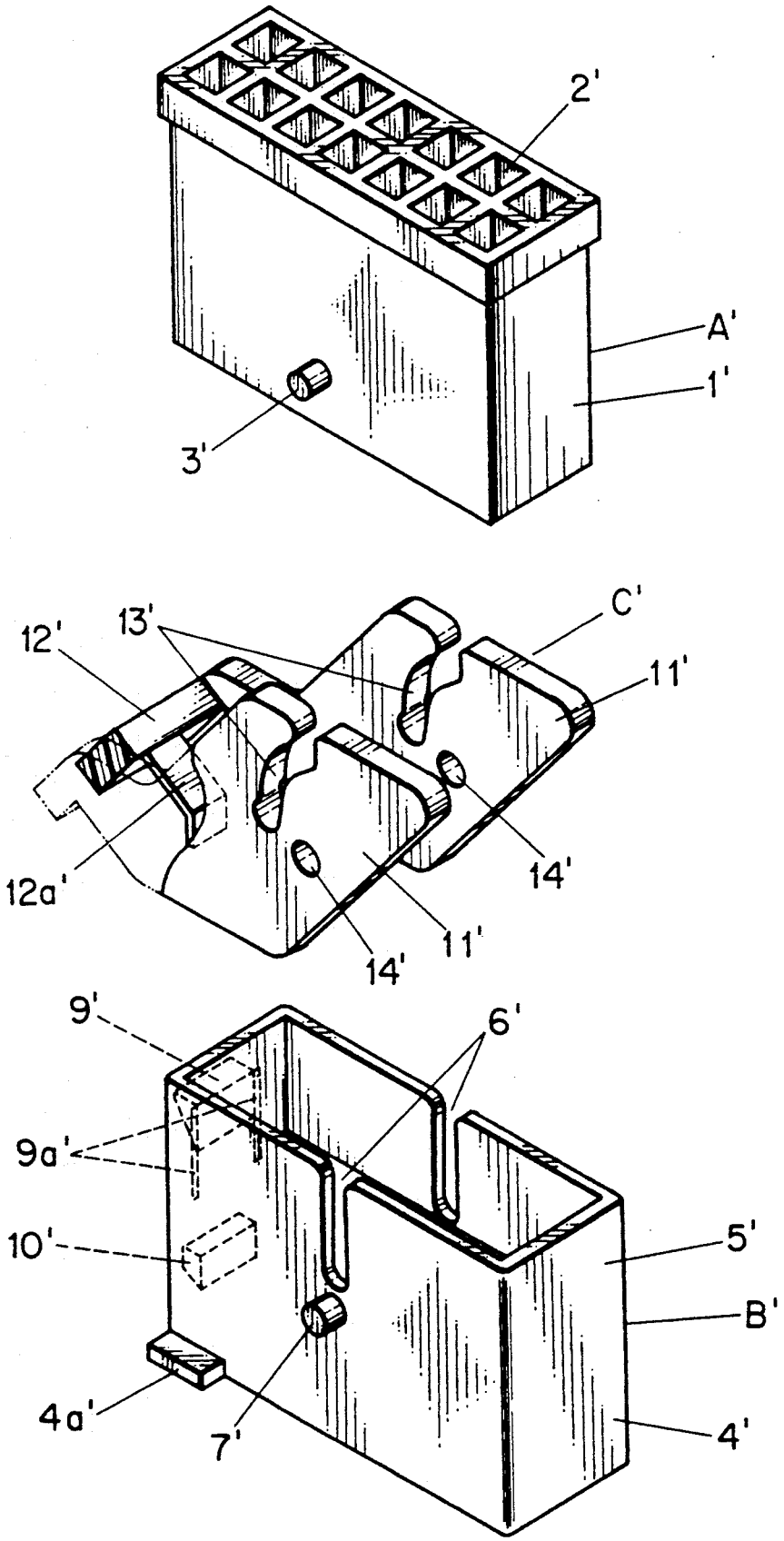
FIG. 24 is an exploded perspective view of a connector with a lever according to a fourth embodiment of the present invention.

FIG. 24 is an exploded perspective view of the connector with a lever according to a fourth embodiment of the present invention. In the figure, denoted A' is a male connector, B' a female connector, and C' a lever. A housing 1' of the male connector A', which is made of synthetic resin, is provided with a plurality of terminal accommodating cavities 2' therein and cam pins 3' on front ends of side walls thereof. A plurality of terminals not shown are accommodated in the terminal cavities 2'.

The female connector B' is provided with a hood 5' for receiving the male connector A' at a front portion of the housing 4' in which male terminals corresponding to the female terminals are accommodated. The hood 5' is provided on side walls with pin guide grooves 6' for the cam pins 3 and pins 7' for supporting the lever C'. Further, on the other wall of the hood 5' is formed a main locking projection 9' with slits 9*a'*. A preliminary locking projection 10' is formed on a lower portion of the same wall that the main locking projection 9' is provided at a position opposite to the projection 9'. Another projection 4*a'* is attached to the other wall of the housing 4'.

The lever C' comprises a pair of side plates 11' and a connecting bar 12' for connecting the side plates 11'. The connecting bar 12' works as an operating portion also. A resilient locking piece 12*a'* extends from the connecting bar 12. On the side walls 11 are formed cam grooves 13' having a shape of an arc and apertures 14', which compose a supporting means with the pins 7' of the female connector B'.

Figure 25A:
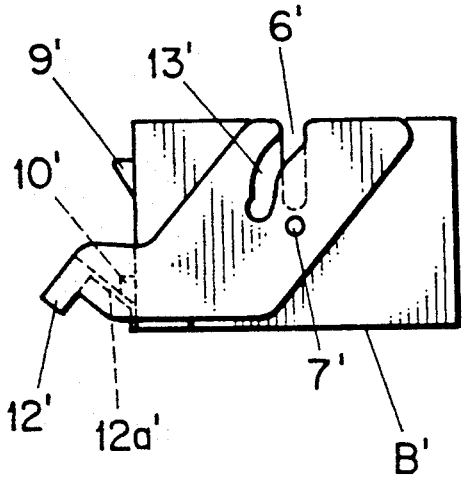
FIGS. 25A to 25D are side views showing connecting process of the male and female connectors.

The connector with a lever according to the fourth embodiment of the present invention has a structure described above. Therefore, as shown in FIG. 25A, the connecting bar 12' is located at a lower position and the resilient locking piece 12*a'* is engaged with the preliminary locking projection 10' of the female connector B'. Open ends of cam grooves 13' overlap pin grooves 6' to receive the cam pins 3 of the male connector A'. The above condition prevents the lever C' from moving downward since a lower end 11*a'* of the side plate of the lever C engages with the projection 4*a'*.

Figure 25B:
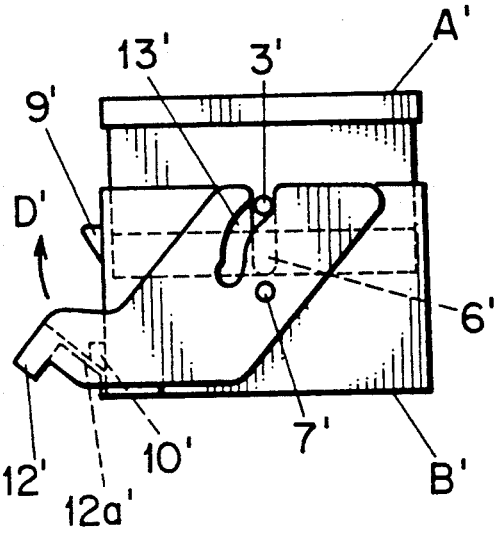
Figure 25C:
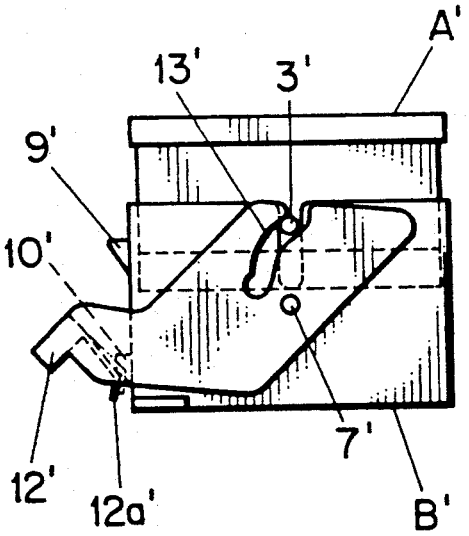
Figure 25D:
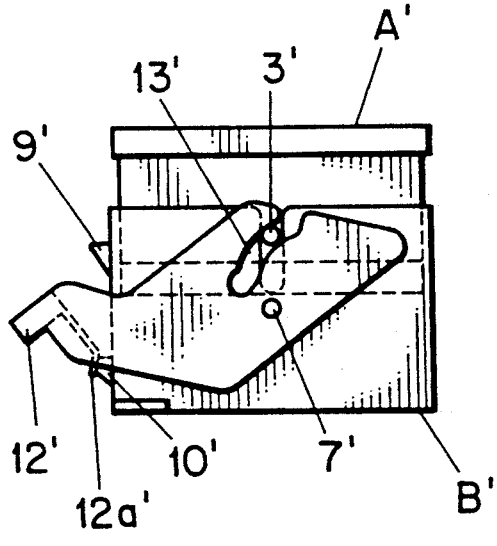
Figure 26:
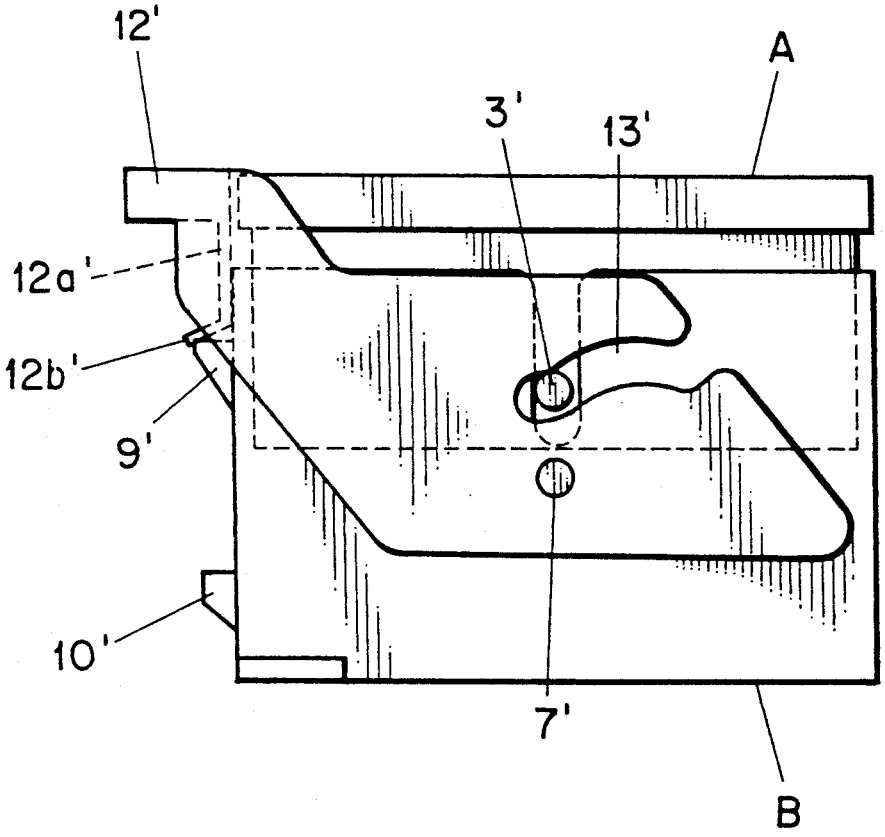
FIG. 26 is a side view showing the condition that the male and female connectors are completely engaged.

Then, the male connector A' is inserted into the female connector B' as shown in FIG. 25B. At this time, the cam pins 3' of the male connector A' are inserted into the pin guide grooves 6' of the hood 5' as well as the cam grooves 13' of the lever C' to slide in the grooves, which gives torque D' counterclockwise to the lever C. As a result, the resilient locking piece 12*a'* of the lever C' is gradually released from the preliminary locking projection as the male connector is inserted as illustrated in FIG. 25C, and when the lever C' is rotated to a position shown in FIG. 25D, the connecting bar 12' of the lever C' becomes free from the female connector B', allowing an operator to hold it for finger operation with ease. Then, the lever C' is rotated clockwise to engage the resilient locking piece 12*a'* of the connecting bar 12' with the main locking projection 9' as described in FIG. 26, which completes the connection of the male and female connectors.

In order to disconnect the male connector A' from the female connector B', the connecting bar 12' of the lever C' is depressed. Then, a tapered portion 12*b'* at the tip of the resilient locking piece 12*a'* is easily released from the main locking projection 9' due to the resilience of the locking piece 12*a'* itself as well as that of the main locking projection 9' with slits 9*a'*. Next, on rotating the lever C counterclockwise, the cam pins 3' slide in the cam grooves 13', which generates force in the direction that the connectors are disconnected. As a result, the disconnection of the male and female connectors proceeds. The open ends of the cam grooves 13' and the pin guide grooves overlap each other at a position where the tip 12*b* of the resilient locking piece 12*a'* engages with the preliminary locking projection 10' to complete disconnection of the connectors, permitting the male connector to be pulled out.

Meanwhile, in the fourth embodiment of the present invention, the resilient locking piece 12*a'* of the lever C' and the fixed preliminary locking projection 10' compose a preliminary locking means. In addition, the resilient locking piece 12*a'* and the main locking projection 9' with the slits 9*a'* compose the main locking means. However, the preliminary locking projection 12*a'* may have resilience in place of the resilient locking piece 12*a'* of the lever C' and the main locking projection 9' also may be formed to have resilience. In other words, one of the members composing a locking means may be formed to have resilience to function as a locking means.

In the above embodiment, the lever is maintained at the preliminary locking position under the condition that the male and female connectors are preliminary locked and then the lever is maintained at the final locking position after the connectors are completely locked. Therefore, natural insertion of the male connector into the female connector provides effective transition to the next operation for engaging both connectors, resulting in smooth engagement work.

Figure 27:
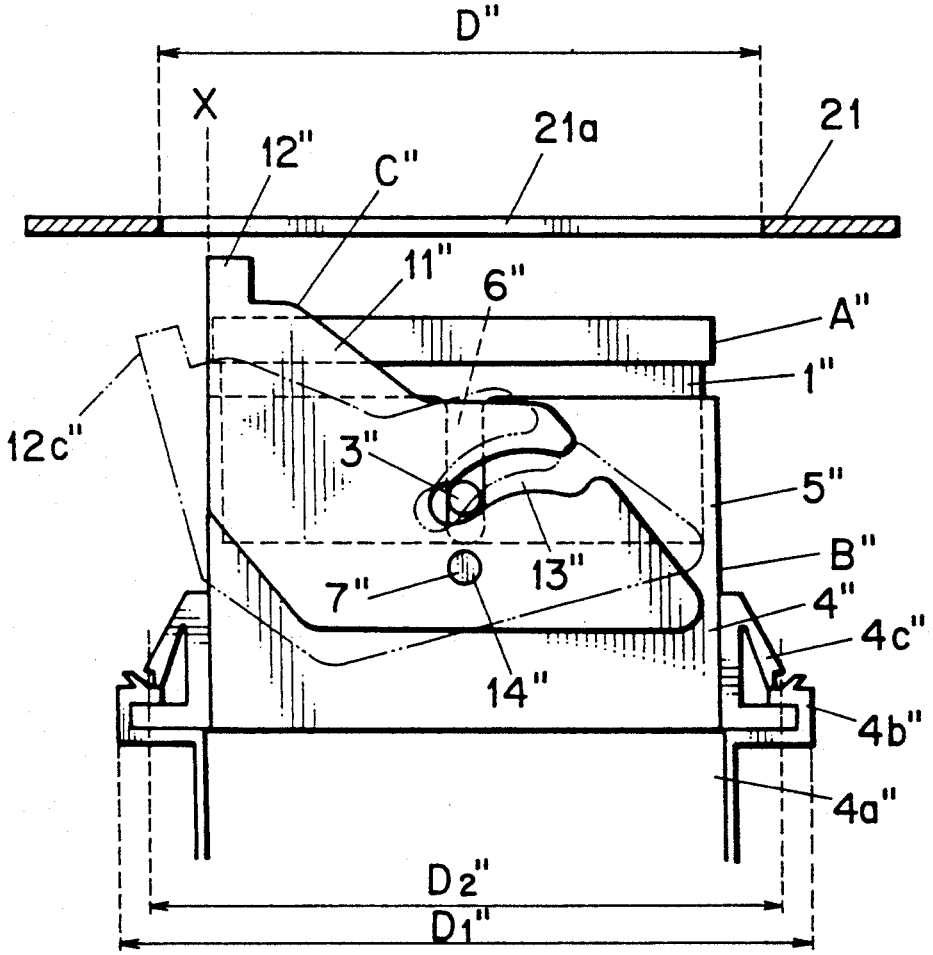
FIG. 27 is a side view of a connector with a lever according to a fifth embodiment of the present invention.
Figure 28:
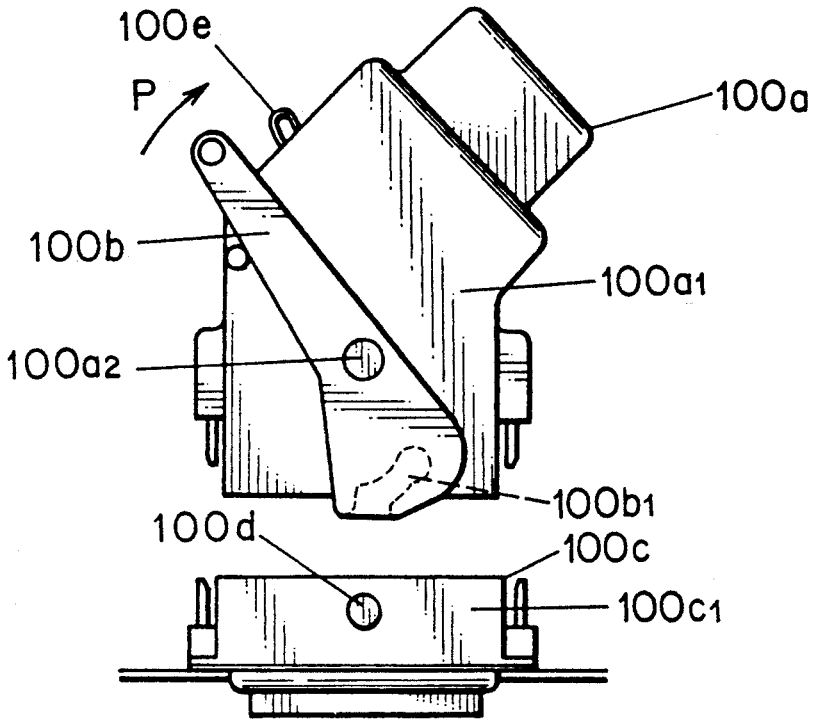
FIG. 28 PRIOR ART
FIG.28 is a side view showing a conventional connectors before engagement.
Figure 29:
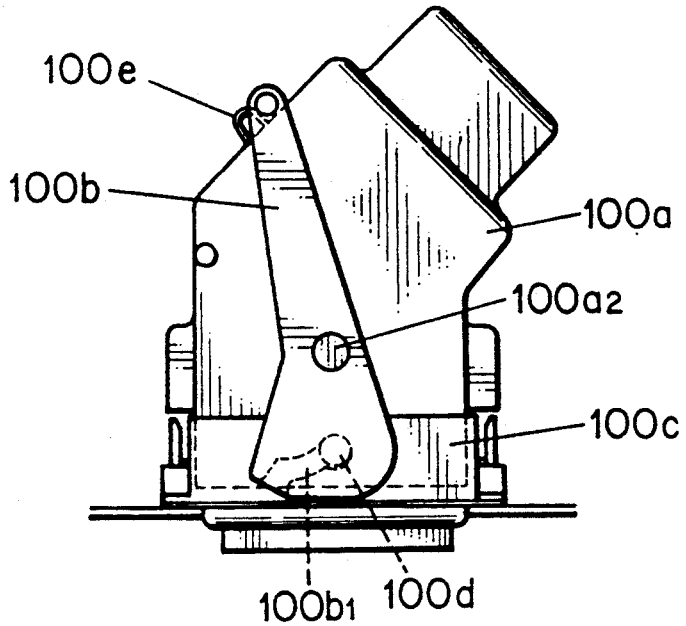
FIG. 29 PRIOR ART
FIG. 29 is a side view showing the conventional connectors of FIG. 28 in final locking state.
Figure 30:
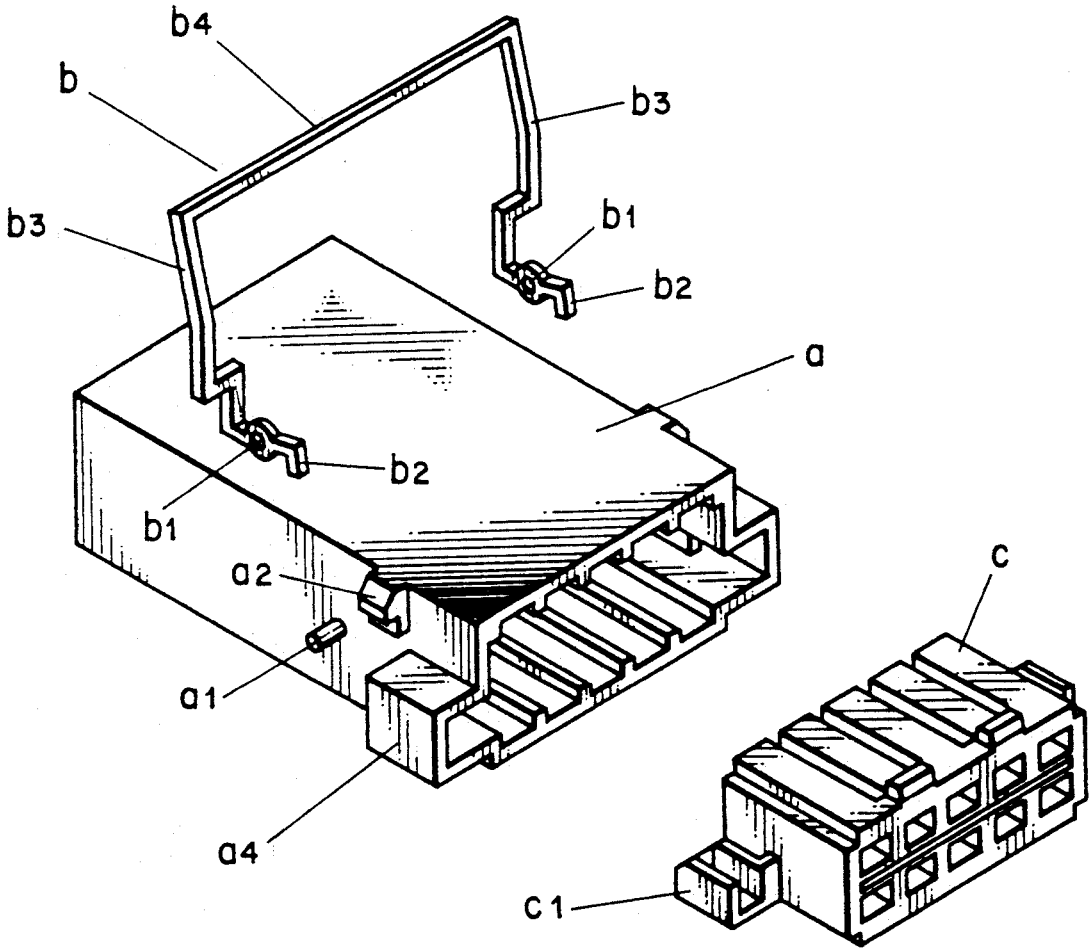
FIG. 30 PRIOR ART
FIG. 30 is an exploded perspective view of another conventional connector with a lever.
Figure 31A:
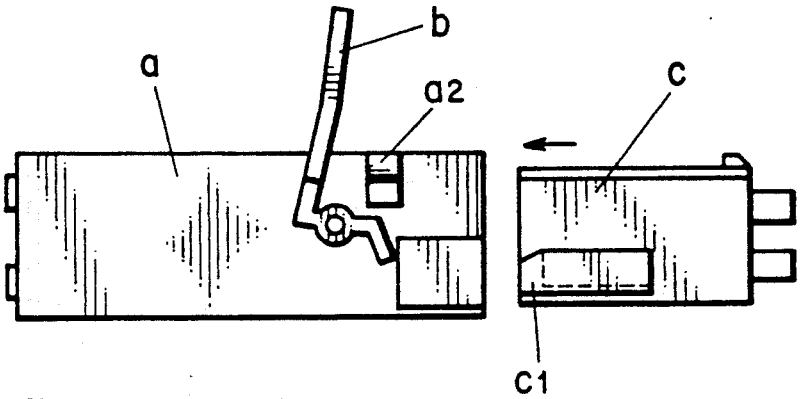
FIG. 31A PRIOR ART
FIGS. 31A to 31D are side views showing the connecting process of the conventional connector with a lever as shown in FIG. 30.
Figure 31B:
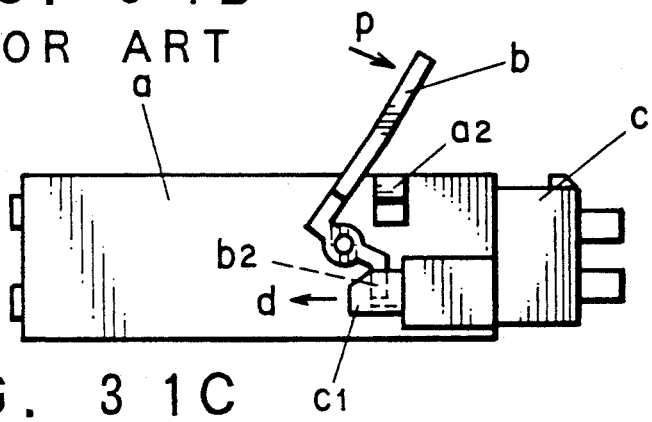
FIG. 31B PRIOR ART
Figure 31C:
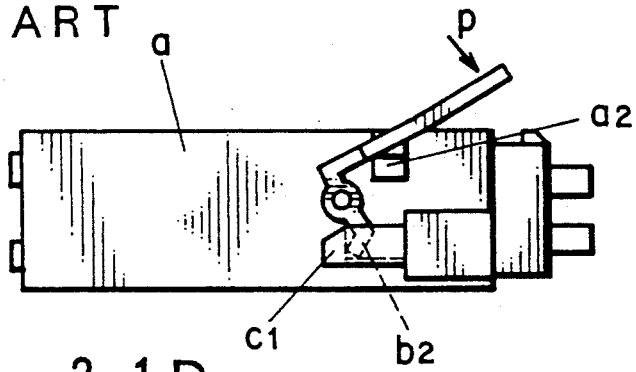
FIG. 31C PRIOR ART
Figure 31D:
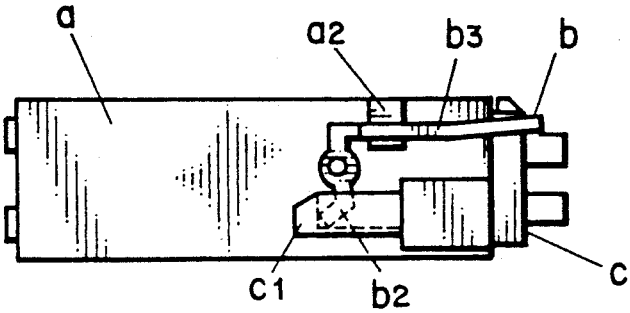
FIG. 31D PRIOR ART
Figure 32:
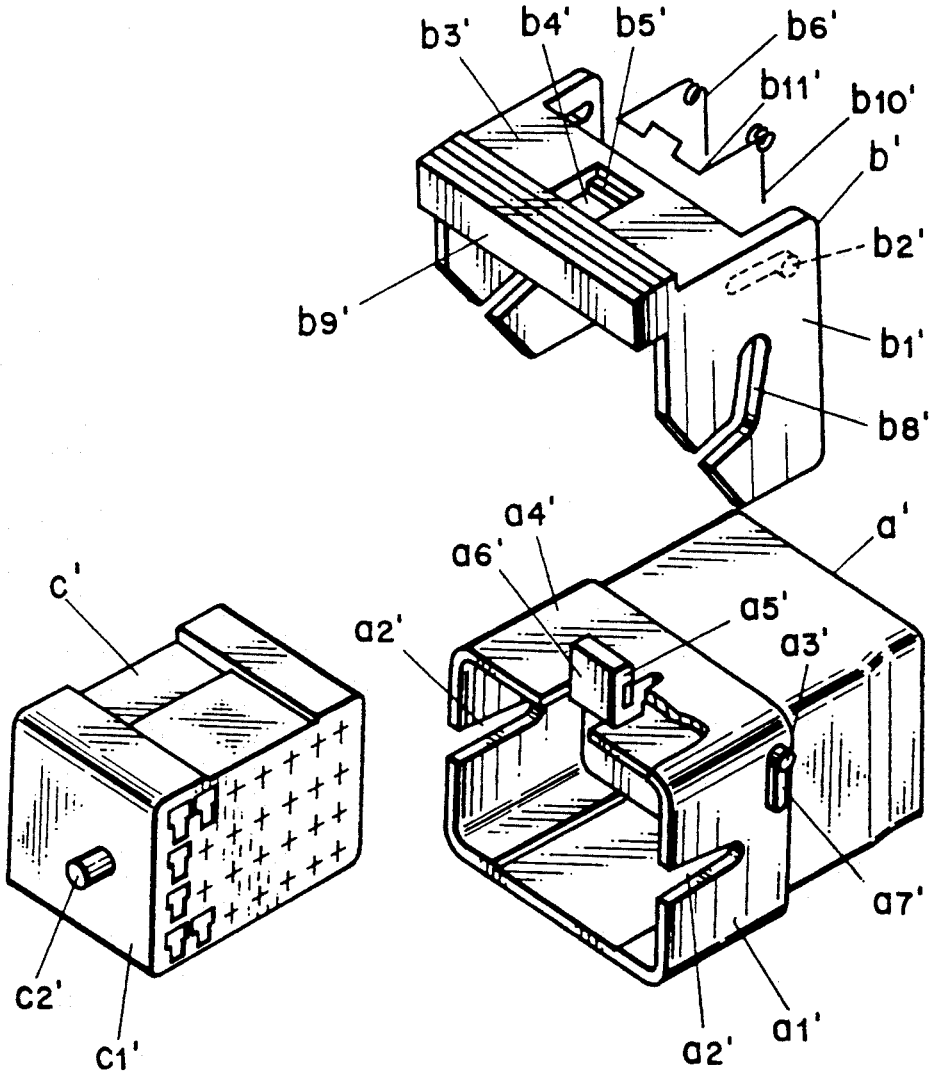
FIG. 32 PRIOR ART
FIG. 32 is an exploded perspective view of a further conventional connector with a lever.
Figure 33:
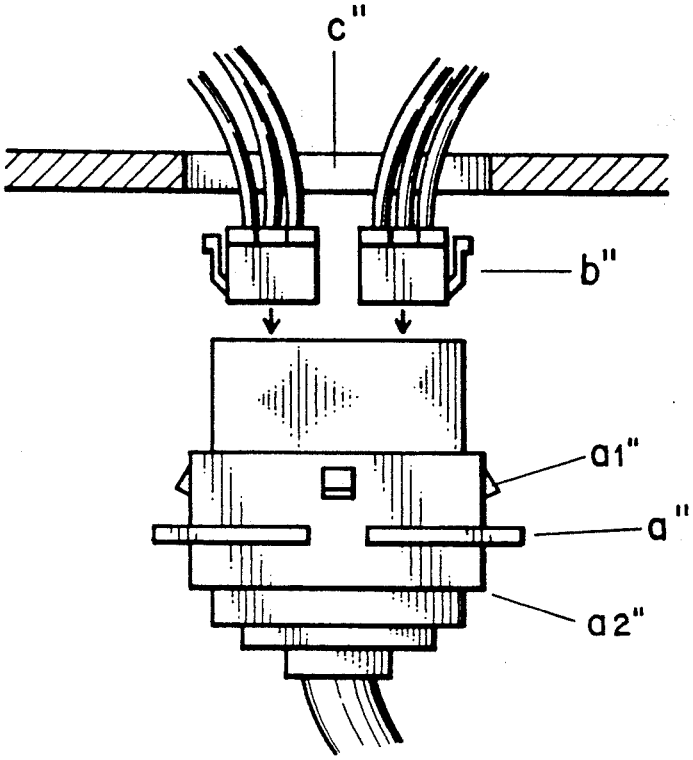
FIG. 33 PRIOR ART
FIG. 33 is an exploded perspective view of a further conventional connector with a lever.
Figure 34:
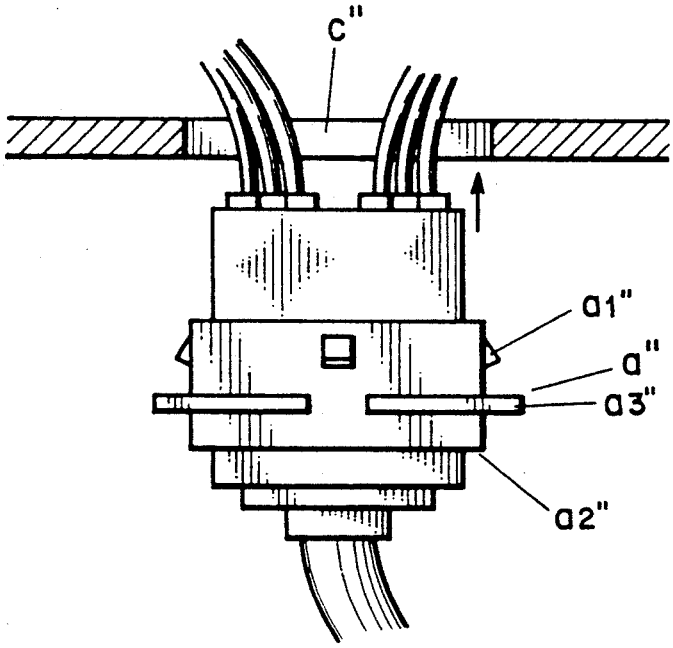
FIG. 34 PRIOR ART
FIG. 34 is a side view of the conventional connector with a lever of FIG. 33 immediately before inserting into a panel opening.

FIG. 27 is a side view of a connector with a lever according to a fifth embodiment of the present invention. In the figure, denoted A" is a male connector, B" a female connector, and C" a lever. A housing 1" of the male connector A", which is made of synthetic resin, is provided with a plurality of terminal accommodating cavities 2" therein and cam pins 3" on front ends of side walls thereof. A plurality of terminals not shown are accommodated in terminal cavities of the male connector A".

The female connector B" is provided with a hood 5" for receiving the male connector A" at a front portion of the housing 4" in which male terminals corresponding to the female terminals are accommodated. The hood 5" is provided on side walls with pin guide grooves 6" for the cam pins 3" and pins 7" for supporting the lever C". The housing 4" is provided with a door grommet 4" at an end portion thereof opposite to the side for receiving the male connector A" and is provided with a seal 4*b"* at a center portion thereof. Further, at portions opposite to the seal 4*b"* are provided resilient locking pieces 4*c"* to form a locking means for the male connector B" when engaged with an opening 21*a* of a panel 21. The diameter D1" of the seal 4" is designed to be slightly larger than that of the opening 21*a* and the distance D2" between tip portions of the resilient locking pieces, which oppose the seal, is slightly larger than the diameter D" of the opening 21*a*.

The lever C" has side plates 11" of which end portions are connected to each other with a connecting bar 12", which functions as a operating portion also. On the side walls 11" are formed cam grooves 13" having a shape of an arc. Apertures 14 compose a supporting means with the pins 7" of the female connector B". The connecting bar 12" of the lever C" is formed so as to be positioned within a right area with respect to a dotted line X, as indicated by a solid line in FIG. 27 under the condition that the male and female connectors are fully engaged. In other words, in case that the connectors are connected incompletely and the female connector B" is inserted into the opening 21*a* of the panel 21, the connecting bar 12" is designed so that a tip thereof abuts a periphery of the opening 21*a*.

When the connector with a lever according to this embodiment having a structure described above is used for an automobile, the depression of the connecting bar 12" of the lever C" permits open ends of the cam grooves 13" to overlap the pin guide grooves. Then, the male connector A" is inserted into the hood 5" of the female connector B" and the connecting bar 12" is lifted to the end, so that the cam grooves 13 slide on the cam pins 3" to draw the male connector A". As a result, the male connector A" is completely engaged with the female connector B" and the connecting bar 12" is positioned within the right area with respect to a dotted line X in FIG. 27. Then, under the condition that the male and female connectors are connected, both connectors are inserted into the opening 21*a* of the panel 21 from the male connector side and the seal 4*b"* is urged to the periphery of the opening 21*a* to be locked by the resilient locking pieces 4C", which terminates the mounting work for the connectors.

With the connector with a lever having the above structure, when the male and female connectors are incompletely engaged, the tip of the lever projects from the outer wall of the hood, allowing an operator to discover such incomplete engagement at a glance. When applied to a connector with a grommet, since the projection at the tip of the lever abuts the periphery of the panel opening, the structure provides a foolproof function.

What is claimed is:

1. A connector with a lever comprising:

a male connector having a front face and a rear face, and at least one terminal accommodating cavity extending between said front and rear faces;

a female connector having a shape of a rectangular frame; male connector and female connector;

pin guide grooves engaged with said cam pins, said pin guide grooves formed on opposing side walls of a second one of said male connector and female connector;

a lever means comprising a pair of levers, a connecting plate for connecting shoulders of said levers, and cam grooves formed on said levers being engaged with said cam pins, said cam grooves having a first cam groove portion for engaging the male and female connectors with each other and a second cam groove portion for locking operation;

a rotating means for rotating said lever means while said pair of levers of the lever means overlap said pin grooves; and a locking means for locking said second one of said connectors to said connecting plate of the lever means, wherein open ends of said pin guide grooves of said second one of said connectors overlap said open ends of said cam grooves of the levers, and said lever means is rotated to connect the male connector with the female connector, and after the connection is completed said locking means locks the lever means to the female connector.

2. A connector with a lever as claimed in claim 1, wherein said cam pins are formed on opposing side walls of the male connector;

said pin guide grooves are formed on opposing side walls of said second one of said connectors so as to extend from front open ends, from which the male connector is inserted, toward a rear end side therefore;

said rotating means comprises supporting pins formed on the female connector and supporting holes formed on the pair of levers; and said locking means comprises a locking projection formed on the female connector and resilient locking member attached to the connecting plate of the lever means.

3. A connector with lever as claimed in claim 2, wherein a positioning projection is attached to one of the side walls of the female connector on which the pin guide grooves are provided;

said lever means engages with said positioning projection such that the open ends of the cam grooves of the lever means overlap the pin guide grooves of the female connector;

a releasing rib is attached to the male connector on the side of the positioning projection of the female connector; and a projection is formed on one of the levers on the side of the positioning projection of the female connector, wherein said lever means is disengaged with said positioning projection when the male connector is inserted into the female connector.

4. A connector with a lever as claimed in claim 2, wherein linear locking grooves are formed adjacent to said cam grooves of the lever means;

said supporting holes of the rotating means includes an insertion hole, a disconnection hole, and a slit formed between said holes;

bosses are attached to inner side walls of the levers of the lever means;

ribs are provided on the same side walls of the female connector that the pin guide grooves are formed, said ribs compose sliding means with said bosses;

a preliminary locking projection is attached to the same wall of the female connector on which the locking projection is mounted;

said lever means is movable in a range between the locking projection and the preliminary locking projection; and supporting pins on the female connector are formed such that the diameter of end portions thereof is larger than that of center portions thereof, whereby at the insertion of the male connector into the female connector, said bosses slide on inner portions of the ribs to position said supporting pins at said insertion hole, and at the disconnection of the male connector from the female connector said bosses slide on outer portion of the ribs to position said supporting pins at said disconnection hole, and the lever means is rotated such that the cam pins engage with said locking grooves to fully connect the male and female connectors, and the lever means is rotated in the opposite direction as the connection to disconnect the connectors at an initial releasing process, and the lever means is shifted for a preliminary engagement such that said supporting pins move form the disconnection holes to the insertion holes at the completion of the disconnection.

5. A connector with a lever as claimed in claim 2, wherein when the male and female connectors are fully locked to each other, said connecting plate of the lever means is positioned on the side of the cam pins of the outer wall of the male connector and female connector, outer wall of the male connector and female connector, which opposes the connecting plate, prior to the fully locked position, said connecting plate is positioned on the opposite side to the cam pins of the male connector with respect to said extension face.

6. A connector with a lever as claimed in claim 2 further comprising a resilient locking member, said resilient locking member comprising:

a linear portion having a spring lock portion at a center portion thereof;

lock releasing portions extending outwardly from ends of the linear portion;

resilient locking portions extending outwardly from ends of the lock releasing portions; and mounting portions for mounting said resilient locking member, said resilient locking portion being assembled along the lever means and urging in the direction that the lock is released, wherein said cam grooves engage with said cam pins at an initial engagement of the male and female connectors, and at least one pair of terminals built in the connectors are connected and the spring lock portion engages with a locking portion of the female connector at a final engagement of the connectors, and the resilient portions of the resilient locking piece cross over a mountain-shaped portion of the female connector at an intermediate engagement of the connectors.

7. A connector with a lever as claimed in claim 6, wherein said lock releasing portions of the resilient locking member project outwardly from slits on the levers.

* * * * *